United States Patent [19]

Gibson et al.

[11] 4,209,248

[45] Jun. 24, 1980

[54] CONTINUOUSLY VARIABLE REDUCTION COPIER OPTICS SYSTEMS

[75] Inventors: David K. Gibson, Boulder; Rick O. Jones, Longmont, both of Colo.

[73] Assignee: International Business Machines Corporation, Armonk, N.Y.

[21] Appl. No.: 904,706

[22] Filed: May 10, 1978

Related U.S. Application Data

[63] Continuation of Ser. No. 721,125, Sep. 7, 1976, abandoned.

[51] Int. Cl.[2] ..... G03G 15/28

[52] U.S. Cl. ..... 355/8; 355/57; 355/58

[58] Field of Search ..... 355/8, 11, 55–62

[56] References Cited

U.S. PATENT DOCUMENTS

| | | | |
|---|---|---|---|
| 2,927,503 | 3/1960 | Zollinger | 355/60 |
| 3,076,392 | 2/1963 | Cerasani et al. | 95/1.7 |
| 3,395,610 | 8/1968 | Evans et al. | 355/11 |
| 3,437,410 | 4/1969 | Tregay et al. | 355/57 |
| 3,542,467 | 11/1970 | Ferguson et al. | 355/8 |
| 3,614,222 | 10/1971 | Post et al. | 355/8 |
| 3,640,615 | 2/1972 | Schaeffer | 355/8 |
| 3,711,199 | 1/1973 | Koizumi | 355/57 |
| 3,829,209 | 8/1974 | Buddendeck et al. | 355/14 |
| 3,897,148 | 7/1975 | Ritchie et al. | 355/57 |
| 3,967,896 | 7/1976 | Looney et al. | 355/14 |
| 3,998,540 | 12/1976 | Weinstein | 355/8 |
| 4,007,986 | 2/1977 | Komori et al. | 355/57 |
| 4,013,361 | 3/1977 | Allis | 355/60 |
| 4,027,963 | 6/1977 | Hoppner et al. | 355/8 |
| 4,029,409 | 6/1977 | Spinelli et al. | 355/51 |
| 4,033,691 | 7/1977 | Bierworth et al. | 355/11 |
| 4,033,692 | 7/1977 | O'Connell | 355/14 |
| 4,093,374 | 6/1978 | Zucker et al. | 355/57 |
| 4,095,880 | 6/1978 | Shogren et al. | 355/8 |
| 4,116,562 | 9/1978 | Libby et al. | 355/60 |
| 4,118,118 | 10/1978 | Barto | 355/8 |

FOREIGN PATENT DOCUMENTS

| | | | |
|---|---|---|---|
| 967796 | 5/1975 | Canada | 355/55 |
| 1397656 | 3/1965 | France . | |

*Primary Examiner*—A. D. Pellinen

*Attorney, Agent, or Firm*—Charles E. Rohrer

[57] ABSTRACT

A continuously variable reduction optical system for document copiers including various embodiments. A scanning optical system embodiment is disclosed for corner referenced documents. Full-exposure optical system embodiments are disclosed for both single-edge referenced and corner referenced documents. The systems can make use of single focus lens or variable focus lens. Specific mechanisms are disclosed for continuously variable adjustments to magnification, to total conjugate length, to image position, to scan speed and scan length and to leading edge registration. All adjustments are tied together under the control of the machine operator.

111 Claims, 22 Drawing Figures

CONTINUOUSLY VARIABLE REDUCTION COPIER OPTICS SYSTEMS

This is a continuation of application Ser. No. 721,125 filed Sept. 7, 1976, now abandoned.

This invention relates to document copier machines and more particularly to document copiers with the capability of reducing the size of document copies in a continuously variable manner. A related patent application is Ser. No. 721,124; filed Sept. 7, 1976, now U.S. Pat. No. 4,120,578.

BACKGROUND OF THE INVENTION

Various document copier machines have been produced with the capability of reducing the size of copies made from the documents placed on the document glass. Most of these machines, however, have been designed for providing specific discrete reduction ratios, e.g., of 0.75:1 or 0.66:1. Rarely has an attempt been made to provide a document copier with the capability of continuously variable reduction from ratios such as 1:1 to another ratio such as, e.g., 0.647:1. The few attempts that do appear in the prior art, e.g., U.S. Pat. No. 2,927,503 to Zollinger, and U.S. Pat. No. 3,395,610 to Evans, have operated with a flash-exposure system. However, the Evans system is designed to overreduce documents and the Zollinger system does not appear to maintain the orientation center line of the lens barrel along the optical axis at all reduction ratios. It is, however, an object of this invention to provide a continuously variable flash-exposure optical system which fills an image area sized to certain copy paper regardless of the magnification ratio selected. Either single-edge referencing or corner referencing can be used to locate the document to be copied at the document plane.

It is a further object of this invention to use a scanning optical system wherein the documents are corner referenced at the document plane. In that regard, it is observed that most conventional non-reduction copy machines utilize a rotating photoconductor-bearing drum with a scanning optical system in order to realize economies over a full-exposure system which must necessarily use a flat imaging surface which results in a mechanically more complex machine occupying more space than a simple rotating drum. Additionally, full-exposure systems have higher power requirements to operate document illumination equipment and can temporarily blind a machine operator if the flash is eye observed. Despite these disadvantages, in reduction optics, most prior art systems opt for the full-exposure procedure to take advantage of the simplicity of its concept. For example, one of the complexities of a scan system utilized in a reduction machine is changing the velocity of the scanning carriages relative to the surface velocity of the rotating drum. Such systems exist in the prior art, exemplified by U.S. Pat. Nos. 3,614,222; 3,897,148; and 3,542,467; but those systems are limited to two, three, and five discrete reduction ratios respectively, and therefore only two, three, or five ratios of velocities. U.S. Pat. Nos. 3,614,222 and 3,897,148 provide corner referencing systems for the document to be copied while U.S. Pat. No. 3,542,467 is a single-edge referencing system. It is, therefore, an object of this invention to provide a drive system for scanning carriages which adjusts the speed of the scan in a continuously variable manner between boundaries in a system in which the document to be copied is corner referenced.

In addition to the change of scan velocity, in a reduction system, the length of the scan must also change relative to the length of the image laid down on the photoconductor. For example, at 1:1, and 11-inch document is scanned into an 11-inch image area, but at a 0.647 reduction, a 17-inch document is scanned into the same 11-inch area. Thus it is a further object of this invention to adjust the length of scan in a continuously variable manner between boundaries in a system in which the document is corner referenced.

A significant problem arises in a reduction scan system involving leading edge registration of the image to the image area. It is desirable for mechanical and timing reasons to match the leading edge of the copy paper to the leading edge of the image area. Therefore, if both the document and the copy paper are $8\frac{1}{2}\times 11$ inches, it is necessary to place the leading edge of the image at the leading edge of the image area in order to transfer the entire image to the copy paper. Also, if a document of 17-inch size is placed on the document glass, it must still be squeezed into an 11-inch image area for transfer to an $8\frac{1}{2}\times 11$-inch sheet of copy paper. Therefore, unless overreduction is practiced, the leading edge of the image of the reduced document must also fall on the leading edge of the image area. However, in a scanning system, as already noted, the scan velocity changes relative to the peripheral velocity of the image area on the photoconductor drum for various reduction ratios. Therefore, the scanning carriage starting position must be shifted in time or space so that it begins to scan the document at the same position on the photoconductive surface regardless of scan speed. Consequently, a further object of this invention is to adjust the leading edge of the scan in a continuous manner with the change in reduction ratio such that the leading edge of the image always falls on the leading edge of the image area, thus enabling the maintenance of a reference corner on the image plane and avoiding any necessity to overreduce.

According to optical theory, in both scanning and full-exposure systems, a reduction ratio calls for a lens position closer to the image than to the object. However, if a lens is shifted from a 1:1 copying position to a reduction ratio, the plane of the image sharpness also shifts (assuming a constant object plane). Therefore, a problem arises for document copier machines where it is desirable to maintain both a stationary object plane and a stationary image plane, as well as maintain image sharpness. This problem has been approached in discrete reduction systems by providing "add" lens at a particular setting to change the focal length of the lens or by rotating a completely new and different lens into place. Obviously, neither of these approaches can be used if a continuously variable system is desired. U.S. Pat. No. 3,395,610 to Evans, mentioned above, apparently attacks the problem by moving a mirror to the center of the larger document, thus establishing a total conjugate length from document to image, and then adjusting the position of the lens to achieve focal sharpness. This approach results in overreduction of the document and therefore limits the range of usable reduction ratios. Therefore, it is another object of this invention to provide a continuously variable reduction ratio with a single-focus lens in a machine with stationary object and image planes while maintaining focal sharpness regardless of the magnification ratio selected, to produce document images which are not overreduced in a scanning system in which the document is corner referenced, and in a full-exposure system with either single-edge or corner-document referencing.

A significant problem in a system in which a document is corner referenced involves the shifting of the center of the exposure area when documents of different size are to be copied into a single-size image area and image edges are to be maintained. The solution to this problem is simple for a two-reduction position system, such as U.S. Pat. No. 3,614,222; where the lens can simply be shifted in two dimensions along a linear path. In U.S. Pat. No. 3,897,148; the lens is moved to three positions with a motion which is probably non-linear, but the only concern is to achieve proper magnification, focal sharpness, and corner referencing at three specific positions. If the lens motion could be halted at some other position, focal sharpness and corner referencing would be lost unless it was achieved purely by chance. However, in a continuous reduction scanning system, such as the instant invention, the lens must be shifted in a variable manner in a dimension perpendicular to the magnification (optical) axis (variable focus lens) or in a curvilinear manner in two dimensions (fixed focus lens), and additionally, while undergoing such a shift, it is desirable for the center line of the lens to remain parallel with the optical axis of the system. In a continuous reduction, full-exposure system with single-edge referencing, the lens must be moved in one dimension perpendicular to the optical axis and in two such dimensions when the document is corner referenced. It is, therefore, a basic object of this invention to provide means for moving the lens in a variable manner along a continuous path, while maintaining the correct orientation of the center of the lens relative to the optical axis of the system, in order to provide a mechanism which maintains the corner reference of a document at both the object and image planes, regardless of reduction ratio, in a continuously variable reduction system.

SUMMARY OF THE INVENTION

Briefly stated, this invention is a continuously variable imaging system for an electrophotographic copier machine wherein preferred embodiments utilize scanning optics for directing the illumination from a corner referenced document to an image plane, and wherein other preferred embodiments utilize full-exposure optics for directing illumination from corner referenced or single-edge referenced documents to an image plane.

More specifically, in a first preferred embodiment of the scanning system a stationary document plane is used upon which a document is corner referenced; it makes use of scanning carriages operating at different speeds to maintain the total conjugate length of a system during scan; it makes use of a positioning drive to make adjustments to the relative position of the scanning carriages prior to scan in order to set total conjugate length in a continuously variable manner for various reduction ratios while maintaining a stationary image plane; it makes use of a positioning drive for locating the lens for continuously variable magnification and for maintaining the corner of the image in constant relation to the corner of the image area regardless of magnification ratio; it makes use of a positioning drive to adjust the position of the leading edge of the image to a constant location on the image plane, regardless of magnification ratio; it makes use of an optics drive system which provides a speed and length of scan which are continuously variable dependent upon the setting of the magnification ratio; and all adjustments are tied together into an optics positioning system under the control of the machine operator.

More specifically, in a first preferred embodiment of the full-exposure system, a stationary document plane is used upon which a document is single-edge referenced (one embodiment) or corner referenced (another embodiment); it makes use of a positioning drive for making adjustments to the position of a mirror carriage in order to set total conjugate length in a continuously variable manner for various reduction ratios while maintaining a stationary image plane; it makes use of a positioning drive for locating the lens for continuously variable magnification and for maintaining the reference edge of the image (one embodiment) or the corner of the image (another embodiment) in constant relation to the image area regardless of magnification ratio; and all adjustments are tied together into an optics positioning sysytem under the control of the machine operator.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

A. In General, Scanning System

Figure 1:
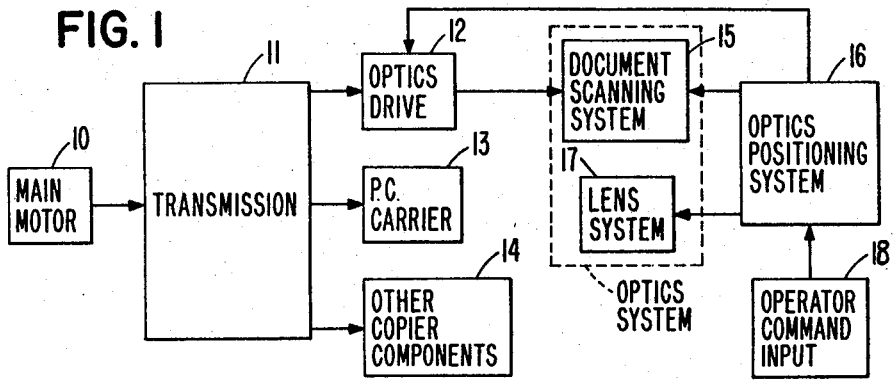
FIG. 1 shows a block diagram of the major components of the document copier utilizing a scanning system.

FIG. 1 shows a block diagram of a preferred embodiment of the invention wherein a main motor 10 is connected through transmission 11 to the optics drive 12, to the photoconductor carrier 13 (which may be a drum or a belt, for example), and to other major copier components 14. The optics drive 12 is connected to the document scanning system 15 to drive scanning carriages across the surface of documents to be copied. An optics positioning system 16 positions the lens 17, provides for total conjugate length corrections, positions the document scanning system 15, and positions the optics drive 12 prior to the start of scan in order to adjust the various parameters for continuously variable reduction. The optics positioning system 16 is under the control of an operator command shown at 18.

In the typical electrophotographic copier machine, of either the plain paper or coated paper type, a document to be copied, typically of rectangular shape, is placed on a glass platen. In several prior art machines, the document has been centered along a reference edge, whereas, in other prior art machines, the document has been placed in a corner of the document glass. However the document is positioned, a scanning carriage may be located under the document glass and moved across the under surface of the document, exposing the document with a moving line of light from one end to the other. This moving line of light is directed through an optical system, including a lens, to a photoconductor carrier which is hereafter described as a rotating drum, the surface of which (in plain paper copiers) is comprised of photodetecting material carrying electrical charge. Obviously, the speed of the scan and the speed of the drum must be matched in a particular ratio, e.g., at a 1:1 ratio the speed of the scan and the peripheral speed of the drum must be the same. The result of the scan is that an electrophotographic latent image of the document is produced on the photodetector. This latent image is then passed through a developer station in which toner material is deposited on the latent image, causing the toner to adhere to certain areas of the photodetector and not to others, depending upon whether light has been transmitted to the drum discharging the electrical charge thereon. In plain paper copiers, the developed image is then passed through a transfer station where the image is transferred to a copy paper sheet. The copy paper is then passed to a fusing station for heating the transferred toner to cause it to permanently affix to the copy sheet. Meanwhile, the drum continues to rotate through a cleaning station where residual toner is removed from the surface of the drum prior to beginning the next copy cycle.

In coated paper copiers the same basic operation occurs except that the photoconducting material is located on the copy paper itself. Therefore, the speed of scan and the speed of the copy paper during image transfer must be matched in the appropriate ratio for the amount of reduction selected. Of course, a positive image must be produced on the coated paper as opposed to a negative image on the photoconductor in a plain paper copier.

In typical electrophotographic plain paper copier machines, the leading edge of the copy paper must be brought into juxtaposition with the drum at the transfer station to coincide with the leading edge of the image area. If the document is to be copied at 1:1 ratio onto a copy sheet of exactly the same size, it is also necessary to provide the leading edge of the document image at the leading edge of the image area so that the entirety of the document can be transferred to the copy sheet. This is obviously the case where $8\frac{1}{2}\times 11$-inch documents are copied onto $8\frac{1}{2}\times 11$-inch copy paper. Typical document copiers, such as the IBM Copier II or Series III, provide the necessary mechanisms for timing the relationship of copy paper leading edge to image area in order to provide this function.

Figure 2A:
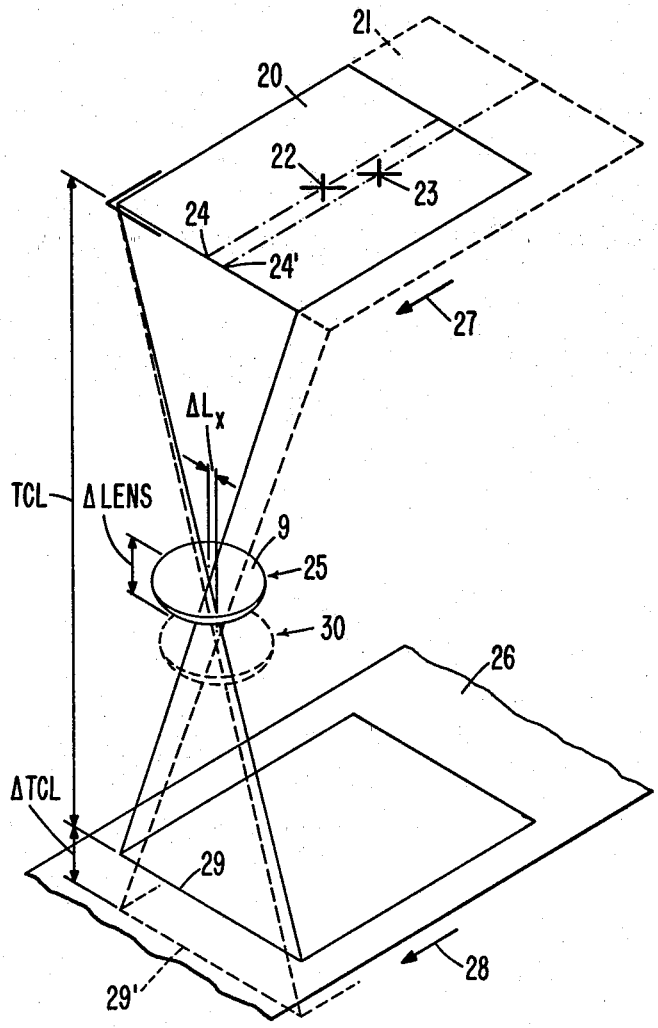
FIG. 2*a* shows an unfolded ray trace of a scanning imaging system to demonstrate the changes in lens position and in the plane of image sharpness for two magnification ratios.
Figure 2B:
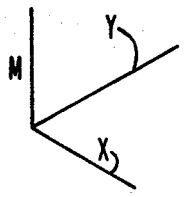
FIG. 2*b* shows orthogonal axes for reference in FIG. 2*a*.

For scanning optical systems, FIG. 2*a* is an illustration of what must take place when documents of different sizes are to be copied upon the same size copy paper. In FIG. 2*a*, a first document 20 is shown positioned at two reference edges forming a reference corner. Similarly, a second rectangular document 21, larger in size than document 20, has been shown positioned at the same reference corner. It should be noted that the center point 22 of document 20 and the center point 23 of document 21 are displaced from one another in two dimensions, X and Y (refer to FIG. 2*b*), while the center point 24 of the exposure area of document 20 and the center point 24' of the exposure area of document 21 are displaced from one another in only one dimension, X, due to the fact that the exposure area in a scanning system approximates a line. A lens 9 is positioned at 25 midway between the document or object plane containing document 20 and an image plane 26 containing the photoreceptive material. By positioning the lens thusly, according to well-known optical principles, the size of the object 20 will be reproduced to the same size at the image plane 26. Thus, in a scanning system, if a line of light is laid down along the reference edge, and document 20 is moved as shown by the arrow 27, an image of document 20 will be laid upon the photoreceptor 26 where the photoreceptor is moved in the direction 28 at a speed which matches the speed of the document scan. A line of light along the reference edge being directed through the lens at position 25 is shown on the photoreceptor 26 at 29. The ray trace shown illustrates that the length of line 29 corresponds to the length of the edge of document 20 along the reference edge.

Should it be desired to copy the larger document 21 onto the same size copy paper as was used for document 20, it it obvious that the edge of document 21 along the reference edge must be reduced at least to the dimension of line 29 on the image plane. The formula for movement of lens in order to gain a reduction of the size of the image calls for moving the lens closer to the image plane along the magnification (optical) axis of the system. The amount of movement (for a thin lens) is determined by the equation:

$$\Delta\text{lens}=f(l-m)$$

where f is the focal length of the lens and m is the reduction ratio. In the present illustration, m may be found by dividing the length of the line 29 by the length of the edge of document 21 along the reference edge.

FIG. 2*a* shows a representation of the movement of the lens 9 from position 25 to a position 30. A ray trace has been drawn from the edges of the document 21 through the lens at position 30 to the image plane. Note, however, that the ray trace passes through the plane of line 29 to some distance below that plane where line 29' is formed to exactly the same size as line 29. The optical phenomenon involved is simply that the plane of focal sharpness of the reduced image is moved beyond the plane of the original image. The distance by which the total conjugate length (the distance between object and image planes) changes is shown in FIG. 2a by ΔTCL. Thus, if focal sharpness is to be maintained, the photoreceptor must be dropped into a new and different plane for each and every reduction ratio. Obviously, practical copy machines generally provide stationary object and image planes and therefore the change in TCL must be provided through other means. Some solutions to this problem include (1) substitution of a new lens with a different focal length and (2) the bringing in of an "add" lens which effectively changes the focal length of the first lens. Both of these solutions would allow for the use of a direct optical system if desired, such as shown in FIG. 2a, but would not admit of a continuously variable reduction system such as the present invention. As will be explained below, the system of this invention provides mirrors to fold the optical path in a manner that enables the continuous adjustment of the mirror and therefore the TCL to whatever length is needed. The thin lens formula for the change in TCL is:

$$\Delta TCL = -f(2 - m - \frac{1}{m})$$

FIG. 2a illustrates that the lens 9 must be shifted in dimension X in order to maintain a corner reference of the documents 20 and 21 on the image plane. Therefore, the lens is moved in two dimensions in a corner referencing reduction system, along the magnification axis, M, and along a perpendicular axis, X. As will be explained below, the system of this invention provides a complex curvilinear motion to position the lens in a continuously correct position in both the M and X axis. The formula for movement of the lens in the X direction is:

$$\Delta L_x = \chi_0[\frac{1 - m}{1 + m}]$$

where $X_0$ is a constant determined by the parameters of the system. Note that $\Delta L_X$ is not a linear movement.

While FIG. 2a has illustrated the magnification and image sharpness principles in a document scan system (moving document), these principles are the same for a linescan system (moving line of light), where the document is stationary.

B. A First Preferred Embodiment

Figure 3:
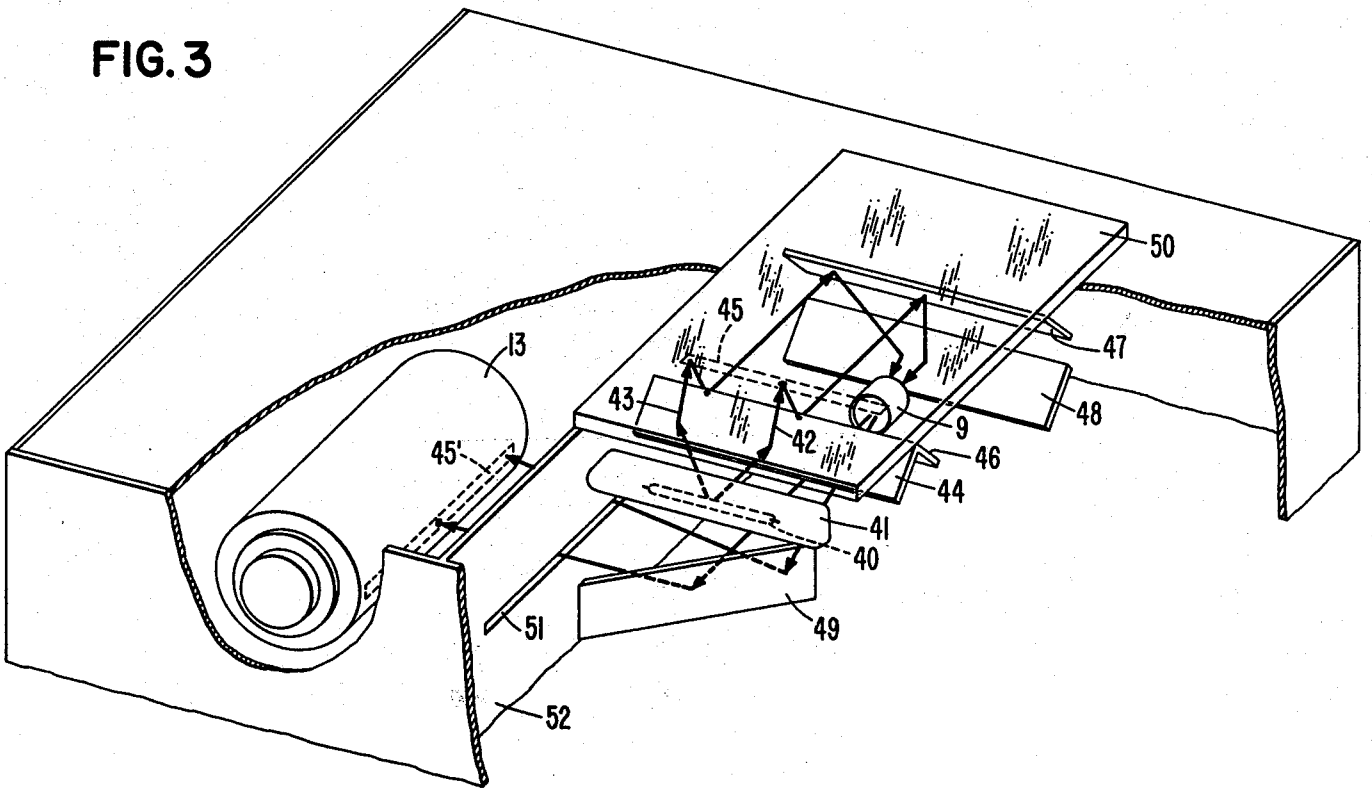
FIG. 3 is an overall perspective of the folded scanning optical system in use in a preferred embodiment of the invention.

FIG. 3 is an overall view of a copy machine constructed according to a first preferred embodiment of the instant invention illustrated generally in FIG. 1, showing the path taken by a ray of light from a document glass through the optical system to the photoconductor drum. A cylindrical bulb 40 is shown partially surrounded by a reflector 41 for producing light rays, two of which are shown at 42 and 43. Ray 42 is drawn along the optical axis of the system, i.e., the axis of the light directed from the document plane (horizontal plane containing line of light 45 on glass platen 50), to the image plane (vertical plane containing the line of light 45' on photosensitive drum 13). Ray 42 emanates from the bulb 40 and is directed onto a dichroic mirror 44 which separates the visible spectrum from infrared radiation. From the dichroic mirror, the visible spectrum is reflected upwardly to the document glass 50 as part of a line of light 45. Ray 42 is then directed downwardly to a mirror 46 across to other mirrors 47 and 48 through the lens 9 to a fourth mirror 49 through an opening 51 to a photosensitive drum 13 thereon forming part of an image line 45'. The ray 43 follows a path similar to ray 42 also producing on the drum part of the line of light 45'.

Figures 5, 5A:
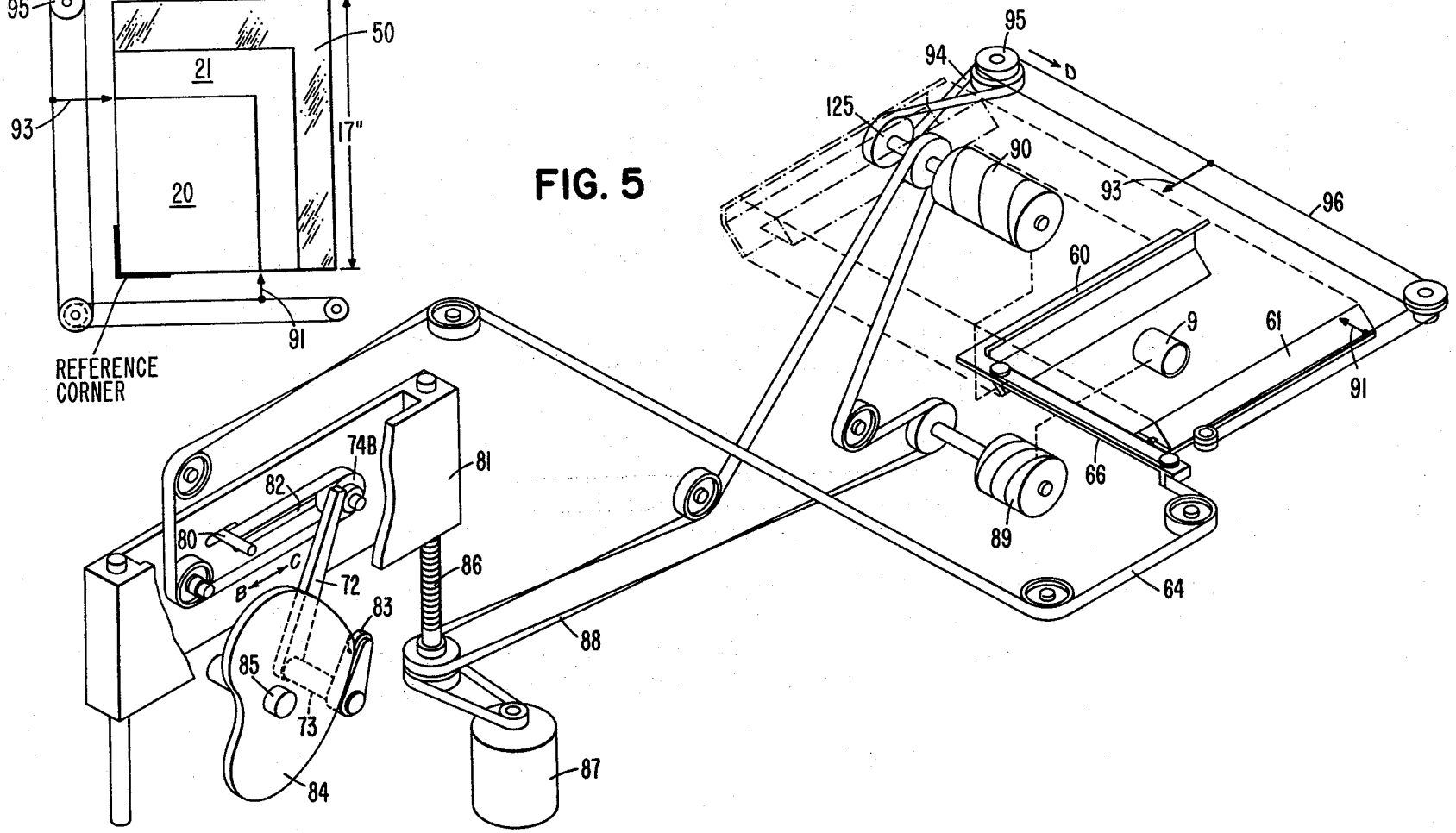
FIG. 5 is a simplified diagrammatic perspective of the scanning optical positioning system together with the optical drive system.
FIG. 5*a* shows the document glass with positioning indicators.

Note that the opening 51 is formed in an interior wall 52, which wall separates the optics system from the remainder of the machine. Within the optics system is the document glass 50, the document scanning system 15 and the lens system 17. In another part of the machine, photosensitive drum 13 is located, and in still another part, not shown in FIG. 3, the optical drive system is found. The optical positioning system is found partly with the optics system and partly with the optical drive system as shown in FIG. 5, discussed below.

Figure 4:
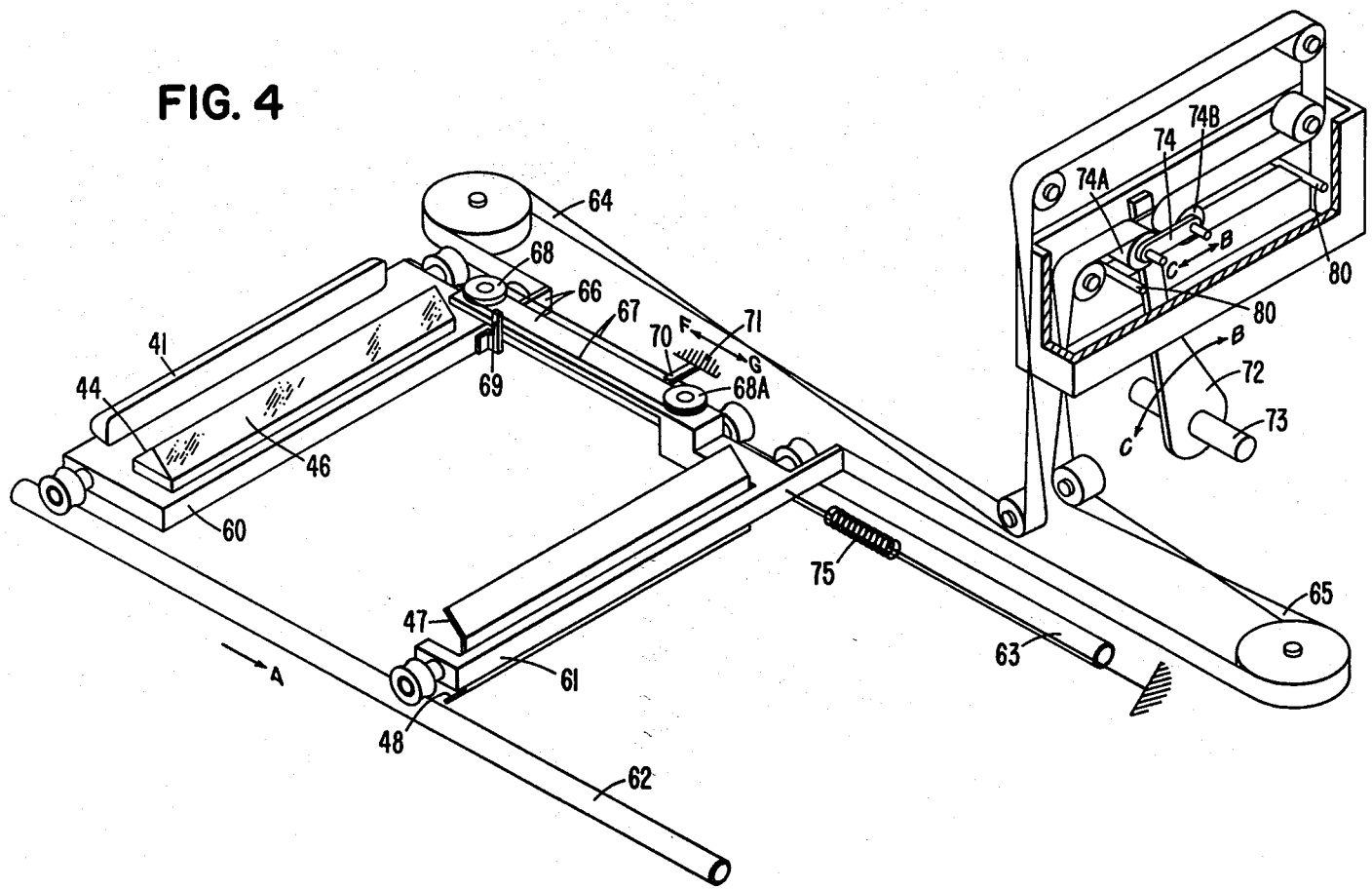
FIG. 4 shows a diagrammatic perspective of the two scanning carriages and the manner in which they are moved.

In FIG. 4 there is shown a diagrammatic perspective of two scanning carriages 60 and 61 which move across the document glass 50 to move the line of light 45 from one end of the document glass to the other. As shown in FIG. 4, scanning carriage 60 carries the source of illumination and its reflector 41, together with the dichroic mirror 44 and the first reflecting mirror 46. Scanning carriage 61 carries two mirrors 47 and 48 which receive light from carriage 60 and bend it by 180° to send it through lens 9 as shown best in FIG. 3. The two scanning carriages are mounted for movement along parallel rail 62 and 63 and are driven by a two-piece drive belt 64 and 65. Drive belt 64 is connected to an arm 66 of the carriage 61, while belt 65 is connected to carriage 61 at the opposite end of arm 66. Obviously, any suitable arrangement of drive cables, including a one-piece cable and/or an open loop cable could be used. The drive belts are looped around pulleys 74A and 74B, located on a drive carriage 74, and are fastened to an adjustable ground point 80, the significance of which is explained below in the section entitled, "Leading Edge Adjustment."

An endless cable 67 passes around pulleys 68 and 68A which are mounted on arm 66. Carriage 60 is attached to endless cable 67 by clamp 69. Note that endless cable 67 is clamped at 70 to movable ground point 71. The significance of the movable ground will be explained below in the section entitled, "The TCL Adjustment."

Note that if drive belts 64 and 65 move scanning carriage 61 in direction A, the scanning carriage 60 will move at twice the speed of carriage 61 because of the velocity multiplying arrangement in which cable 67 is clamped to ground point 71. Thus, a system is provided in which the slower moving carriage is the directly driven carriage while the faster moving carriage is driven through a motion multiplier from the driven slower moving carriage. The significance of moving one of the scanning carriages at twice the speed of the other will be explained below in the section entitled, "Keeping the TCL Constant During Scan."

The manner in which driven carriage 61 is moved is shown in FIG. 4 to be from a drive arm 72 which is rotated by shaft 73. As driven arm 72 is moved in a reciprocating manner, in the direction of arrow B, drive carriage 74 is moved in direction B. Since drive cables 64 and 65 are connected by pulleys 74A and 74B to opposite ends of drive carriage 74, motion of drive arm 72 in direction B causes the two scanning carriages to move in direction A. The spring 75 exerts a biasing force on the system, such that the drive carriage 74 is always biased against the drive arm 72. Thus, as movement occurs in the direction B, a tensioned spring 75 exerts the force to bring the carriages in direction A and maintain drive carriage 74 against the drive arm 72. When the reciprocating arm returns in direction C, the spring 75 is retensioned.

FIG. 5 shows a cutaway view of the drive system and also provides a diagrammatic representation of the optics positioning system. Carriages 60 and 61 are shown together with cable 64 connected to arm 66. For simplicity, drive cable 65 has been deleted. Cable 64 is shown passing around a pulley on drive carriage 74 to a movable ground point 80 (only pulley 74B of drive carriage 74 is shown in FIG. 5). Cable 65 (not shown) is also connected to drive carriage 74 around pulley 74A (not shown) and from there to adjustable ground point 80. Drive carriage 74 is mounted in a truck 81, and in the diagrammatic representation shown here, slots have been cut into truck 81, one of which is shown at 82, for supporting the drive carriage 74 and allowing it to move in the directions B and C under the influence of drive arm 72. Drive arm 72 is connected by shaft 73 to cam follower 83 which follows drive cam 84. Cam 84 is driven by shaft 85 which is connected by a transmission to the main motor (shown in FIG. 1).

Truck 81 is positioned in a continuously variable manner along lead screw 86 by optics positioning motor 87. Motor 87 also drives positioning cable 88 which turns the optics cam 89 and the focal sharpness cam 90, the latter cam provided for adjusting total conjugate length. Thus, it is seen that through cable 88, the magnification ratio and the total conjugate length are tied together for simultaneous adjustment. Also, it should be noted that the truck 81 is adjusted simultaneously with the lens and TCL cams so that the position of drive carriage 74 along drive arm 72 is altered accordingly. The significance of the change in the position of drive carriage 74 will be discussed below.

FIGS. 5 and 5*a* also show the system for feeding back information to the operator to inform him when the optics positioning system is adjusted properly. The document is positioned on the document glass in the manner shown in FIG. 5*a* at a reference corner. Positioning indicators 91 and 93 are moved simultaneously by the operator to encompass the outer edges of the document in two dimensions. By observing the position of the indicators 91 and 93, relative to the document, the operator knows when he has the system adjusted such that the entirety of the document is encompassed by the indicators and therefore will be transmitted to the document image area when he presses a "Make Copy" button.

As shown in FIG. 5, indicating pointers 91 and 93 are operated by positioning motor 87 throgh cable 88, pulley 125, and cable 94. If pulley 95 is rotated in direction D, then cable 96 rotates to move positioning indicator 93 in a direction to encompass a larger and larger document. Similarly, positioning indicator 91 moves to encompass a larger document along the other dimension. The positioning indicators 91 and 93 may move at any selected ratio depending upon the nominal sizes of paper most frequently copied. For example, if $8\frac{1}{2}\times 11$-inch paper is the usual size to be copied, and if the reduction ratio at its maximum setting could copy two $8\frac{1}{2}\times 11$-inch documents, then positioning indicator 93 must move from an 11-inch mark to a 17-inch mark, while positioning indicator 91 need only move from $8\frac{1}{2}$ to 11 inches. However, the ratio of $8\frac{1}{2}$:11 must be maintained in order to copy the $8\frac{1}{2}\times 11$-inch size at 1:1 and therefore positioning indicator 91 must actually move to the 13.1-inch mark rather than the 11-inch mark when indicator 93 is at the 17-inch mark. Therefore, while the indicators and all other adjustments in the system are capable of reducing 13.1-inch documents, it is probable that 11-inch documents are the maximum size required. Therefore, if desired, the document glass may be less than 13.1 inches, although the indicator movement may not be less than that amount.

Figure 6:
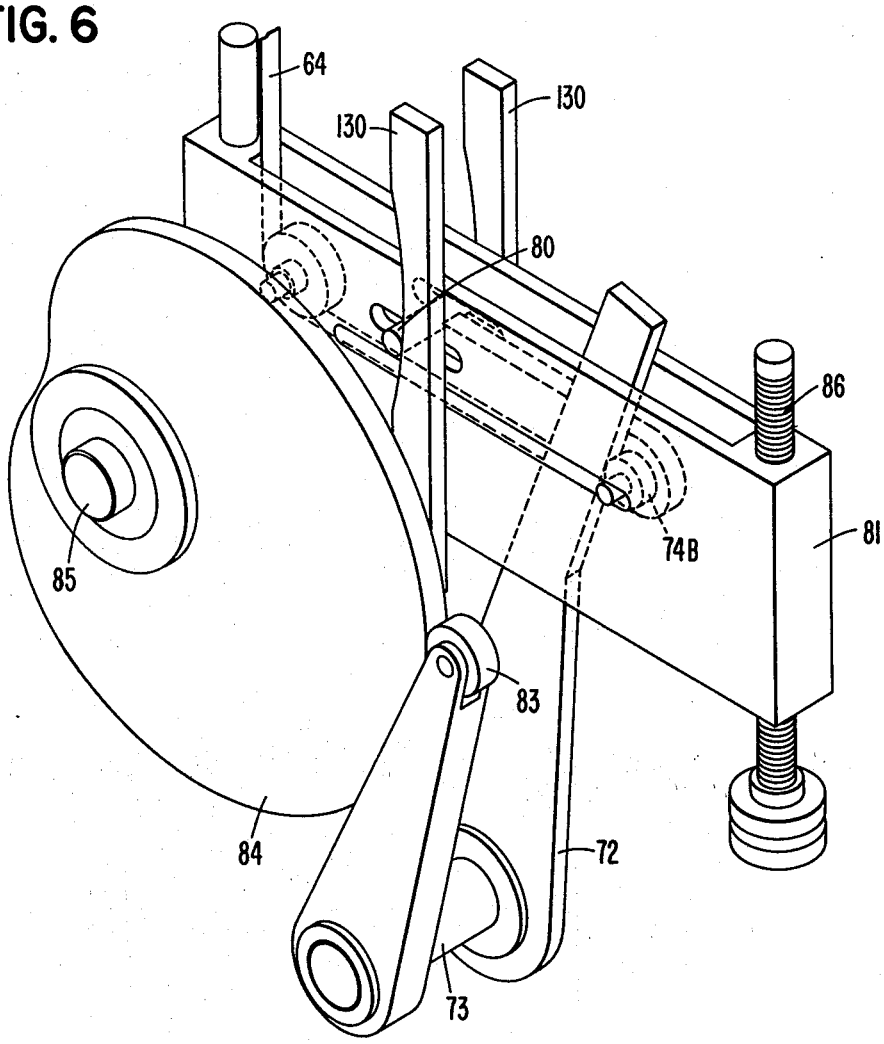
FIG. 6 shows another perspective of the scanning optical drive system.

FIG. 6 is a detailed perspective view of the optics drive system. Truck 81 is shown mounted for vertical movement along lead screw 86. Movably mounted in truck 81 is drive carriage 74 to which drive cable 64 is attached by passing around a pulley 74B on the drive carriage to the adjustable ground point 80 on truck 81. For simplicity, the drive cable 65 is not shown, and only pulley 74B of drive carriage 74 is shown.

During scan, drive carriage 74 is moved in a reciprocating manner in the truck 81 by the drive arm 72. Drive arm 72 is moved on its pivot point by shaft 73 under the influence of drive cam 84 and follower 83. Each 360° of drive cam rotation involves a movement of the scanning carriages in both a scan and a rescan direction. The shape of the cam 84 is such as to provide a constant velocity to the carriages as they move through the scan. Continuous variation in scan velocity is obtained by moving the truck 81 up and down the lead screw 86 which repositions the drive carriage 74 along drive arm 72 prior to scan. If the carriage 74 is positioned near the top of drive arm 72, the carriage 74 will be moved at a faster velocity through a greater distance by arm 72 than it would with the drive carriage 74 positioned near the bottom of drive arm 72. Thus, the velocity of the scan and the length of the scan are controlled by the velocity and the length of movement of drive carriage 74 which in turn is a result of the positioning of carriage 74 along arm 72.

Figure 8:
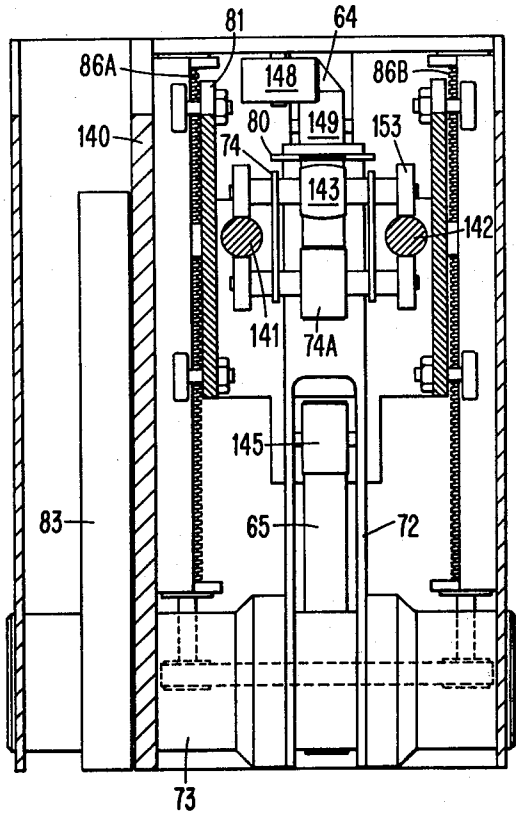
FIG. 8 is a sectional view taken along line 8—8 of FIG. 7.
Figure 7:
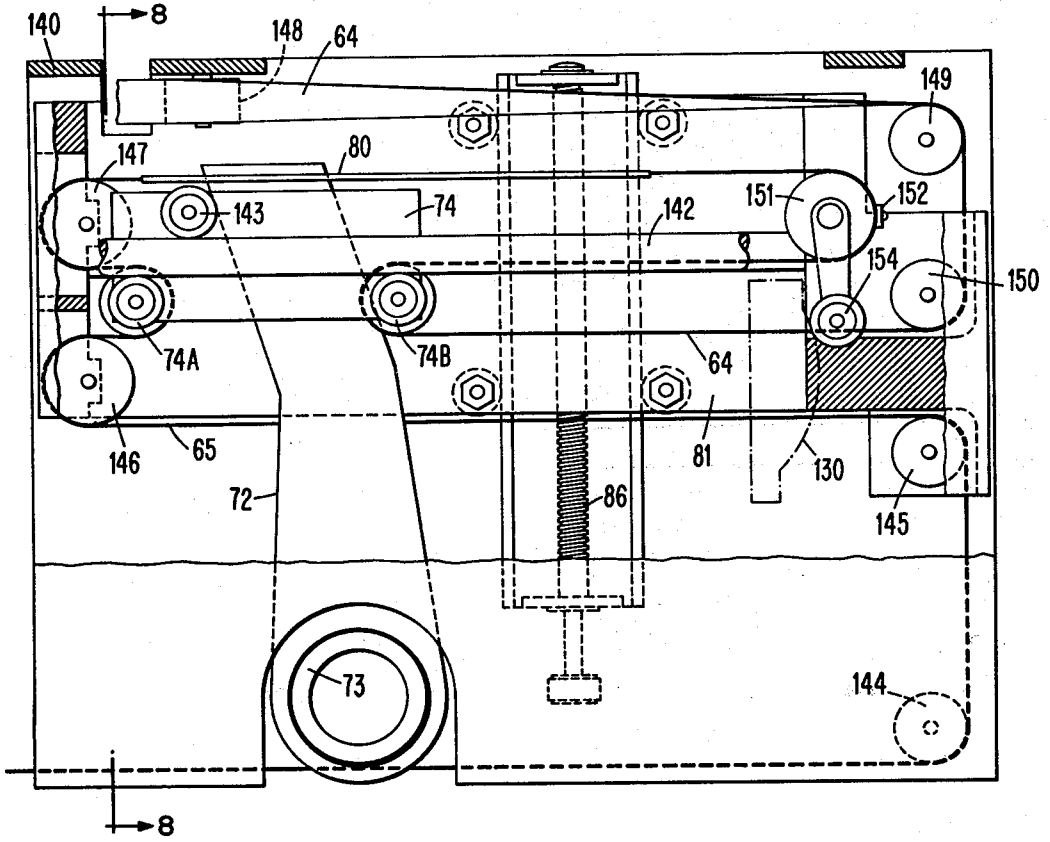
FIG. 7 shows a preferred embodiment of the scanning optical drive system.

FIGS. 7 and 8 are views of a preferred embodiment of the optics drive system as it may be actually constructed. FIG. 8 is a sectional view taken along line 8—8 in FIG. 7.

Referring to FIG. 7, drive carriage 74 is shown with pulleys 74A and 74B at opposite ends thereof. Follower 143 is mounted on carriage 74 and provides the bearing surface for contact with drive arm 72. FIG. 8 shows that carriage 74 is mounted on parallel rails 141 and 142 by wheels such as 153. Rails 141 and 142 are mounted in truck 81 which is moved in a vertical direction by drive screws 86A and 86B. A housing 140 generally encloses truck 81 and provides structural support.

FIG. 7 also shows the path of drive cables 64 and 65. Drive cable 65 passes around pulley 144 mounted on stationary housing 140 and goes to pulleys 145 and 146 which are mounted on the vertically movable truck 81. Cable 65 then passes around pulley 74A on drive carriage 74 and pulley 147 on truck 81 to the adjustable ground point 80. Cable 64 passes around pulleys 148 and 149 mounted on stationary housing 140 and goes to pulley 150 mounted on movable truck 81. Cable 64 then passes around pulley 74B on drive carriage 74 and pulley 151 on truck 81 to adjustable ground point 80.

Note that drive cable 64 is grounded by clamp 152 to pulley 151 and thereby to truck 81. Pulley 152 is rigidly connected to cam follower 154 which rides on locating cam 130. Thus, as the truck 81 is moved downwardly from the position shown in FIG. 7, clamp 152 is rotated in a counterclockwise direction. Such rotation adjusts the position of ground point 80, paying out cable 65 and taking in cable 64. Again, the significance of this adjustment will be described below.

Figure 9:
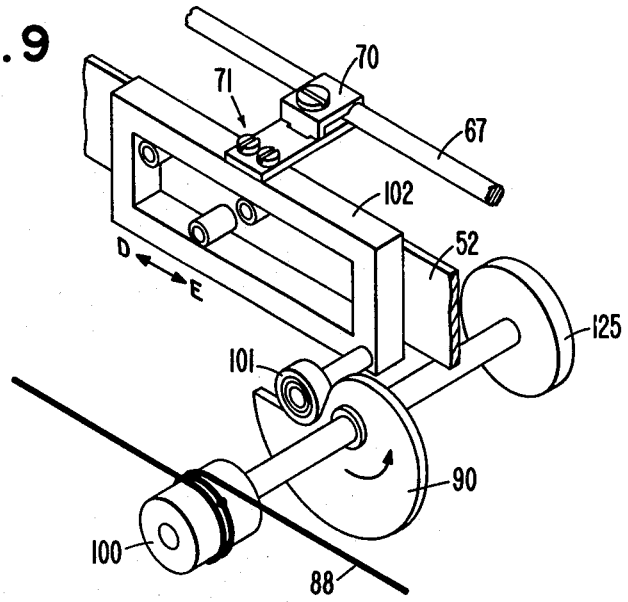
FIG. 9 is a perspective of the total conjugate length (TCL) adjusting mechanism in the scanning system.

FIG. 9 is a view of the TCL cam 90 which positions the movable ground point 71 to provide a total conjugate length adjustment. Cam 90 is driven from the optics positioning cable 88 which is wrapped around and attached to a drive pulley 100. Cam follower 101 is attached to the TCL truck 102 which is moved in a reciprocating manner in the directions D and E under the influence of cam 90. Note that truck 102 is positioned near the interior wall 52 shown also in FIG. 3. By moving the truck 102, a ground point 71 for the cable 67 is moved in the directions D and E. In referring again to FIG. 4, note that the cable 67 is the endless cable mounted on the arm of 66 of carriage 61. Attached to the endless cable 67 is the other scanning carriage 60. Thus, by moving the ground point 71 an adjustment is made to the distances between the carriages 60 and 61 prior to the start of a scan. In that manner, the distances between mirrors mounted on carriages 60 and 61 are adjusted, thus the total conjugate length is adjusted for different magnification ratios.

Figure 10:
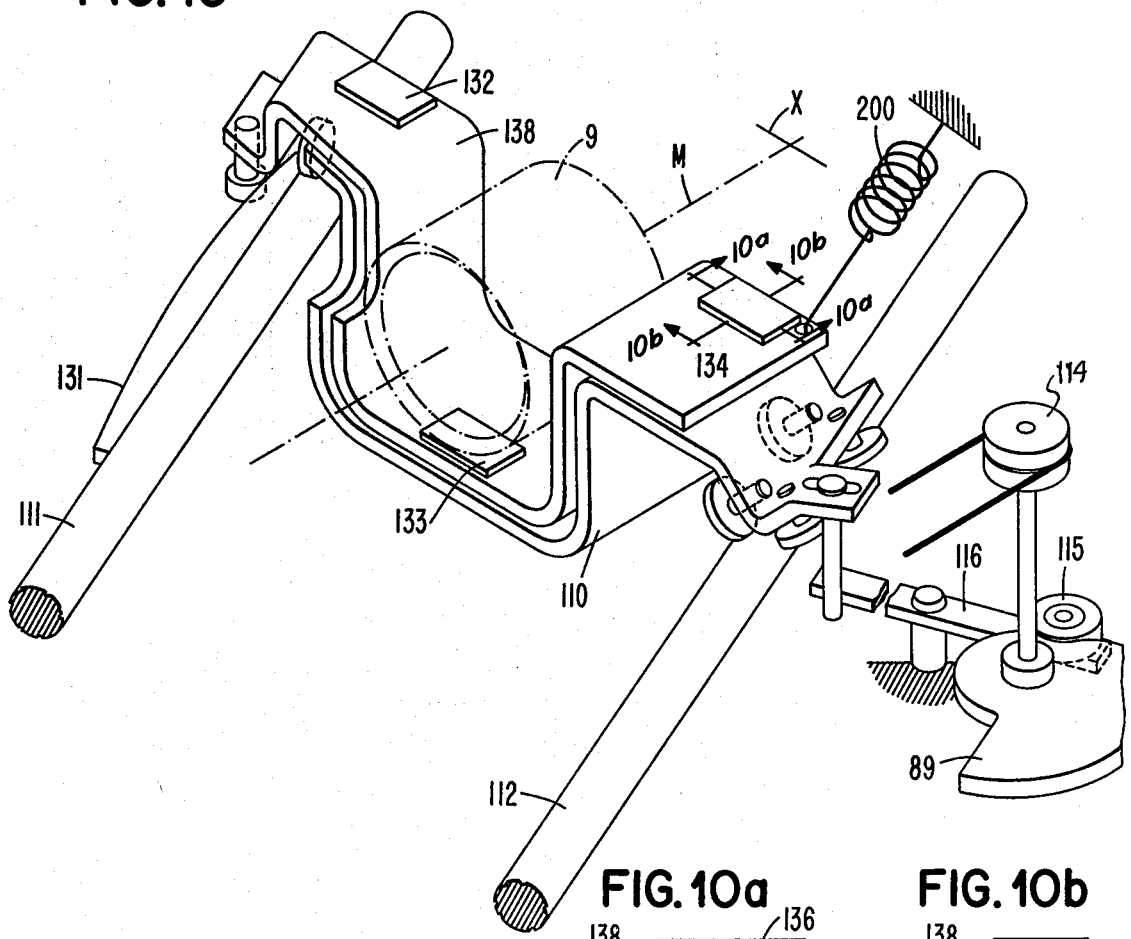
FIGS. 10, 10*a*, and 10*b* show the magnification adjustment and corner reference adjusting mechanisms together with the lens carriage in the scanning system.

FIG. 10 shows the lens 9, in phantom, mounted in lens carriage 138, which in turn is movably mounted in lens carriage 110. The carriage 110 rides on rails 111 and 112 to carry the lens 9 along the magnification axis M. The carriage 110 is moved under the influence of magnification cam 89 which is positioned by the optics positioning cable 88 attached to drive pulley 114. Cam follower 115 is mounted upon a pivoted arm 116 which physically moves the lens mount 110. Spring 200 is attached to carriage 110 and biases it against arm 116. Thus, when the optics positioning motor 87, shown in FIG. 5, is rotated, the lens 9 is positioned in a non-linear manner along the magnification axis M through the optics positioning system, including drive cable 88, cam 89 and arm 116.

Also, FIG. 10 shows that the rails 111 and 112 are aligned at an angle in the X dimension to the M axis, so that when the carriage 110 is moved along the M axis, the lens 9 is carried along the X dimension as well. A cam follower (not shown) directly connected to carriage 138, bears against cam 131 so that as carriage 110 moves along the rails 111 and 112, carriage 138 is moved along the X axis relative to carriage 110 in a non-linear manner. Thus, as the optics positioning system adjusts the magnification ratio, it also moves the lens in a second dimension in a non-linear manner in order to maintain the corner reference. Note also, that the system provided maintains the center line of the lens barrel parallel to the optical axis of the system.

Figure 10A:
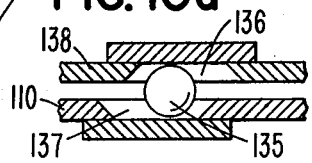
Figure 10B:
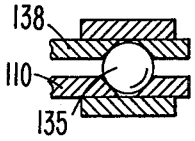

Second lens carriage 138 is slidably connected to carriage 110 through a triangulation mount 132, 133 and 134. Referring to FIGS. 10*a* and 10*b*, each of these mounts comprise facing "V-shaped" slots 136 and 137 in the carriage surfaces with a steel ball 135 held within the slots. The two carriages 110 and 138 are held together by springs, not shown, providing the force to keep ball 135 in the slots. Thus, as carriage 110 is moved, carriage 138 is allowed to slide in the X dimension relative to carriage 110 under the influence of cam 131.

C. Operation of the Machine a. Keeping the TCL Constant During Scan

Mechanisms have been described hereinabove for adjusting the TCL (total conjugate length) to a particular value prior to scan depending upon the particular reduction ratio selected. Obviously, that TCL setting must remain constant throughout the scanning of the document and the two components of total conjugate length, the distance from the document glass to the lens, and the distance of the lens to the image plane must remain constant as well. Note that as carriage 60, carrying the illumination lamp and the first reflecting mirror 46, moves across the document glass, the distance from mirror 46 to the lens 9 shortens (see FIG. 3) unless carriage 61 carrying reflectors 47 and 48 is moved away from the lens 9. Referring to FIG. 3, observe that as mirror 46 is moved toward the back of the machine mirrors 47 and 48 must also be moved toward the back of the machine and the ratio of movement must be at half the speed at which mirror 46 moves for the total distance from mirror 46 to lens 9 to remain constant. The reason is obvious since there are two mirrors 47 and 48 on carriage 61 moving away from lens 9, therefore the total path length as a result of the movements of these mirrors is twice that of the movement of mirror 46. Consequently, to maintain TCL as the scanning carriages move across the document glass, a system must be provided to move carriage 61 at half the speed of carriage 60.

Referring now to FIG. 4, it can be seen that the above-described motion is obtained by driving the slower moving carriage 61 through drive cables 64 and 65. The faster moving carriage 60 is connected along one side of an endless cable 67 between pulleys which are mounted on carriage 61. The opposite side of endless cable 67 is grounded at 71, thus providing a motion multiplier which moves the carriage 60 at twice the speed of carriage 61.

b. The Magnification Adjustment

Referring to FIG. 5, whenever positioning motor 87 is energized, the positioning indicators 91 and 93 are moved to encompass the document placed on the document glass. To move these indicators, the operator simply operates a switch (not shown) which energizes motor 87, causing it to rotate until the operator signals stop. As the indicators move to encompass the document, so also the drive cable 88 moves magnification cam 89 to position the lens 9 at a magnification setting to copy the area of the document glass encompassed by the positioning indicators. Thus the lens 9 is always moved in synchronism with those indicators with the result that whatever the area encompassed by the indicators, the magnification is adjusted to place that area on a chosen image area, such as an $8\frac{1}{2}\times 11$-inch image area on the photoconductor drum. Again, the specific mechanism for moving the lens is shown in FIG. 10.

c. The Corner Reference Adjustment

Referring again to FIG. 5, as the positioning motor 87 continuously moves indicators 91 and 93 to encompass an area to be copied, lens 9 is continuously moved by motor 87 in synchronism with the indicators to provide the correct reduction and to maintain the corner reference on the image plane while keeping the centerline of the lens barrel parallel to the centerline of the system optics. As the indicators move to encompass the document, drive cable 88 moves magnification cam 89 which repositions lens carriage 110 (see FIG. 10) in two dimensions, the magnification axis and a perpendicular dimension as well. Additionally, as carriage 110 moves, a second lens carriage 138 moves with it under the influence of corner cam 131 to maintain the corner reference on the image plane.

d. The TCL Adjustment

Referring again to FIG. 5, as the operator maintains motor 87 in rotation, drive belt 88 turns the TCL cam 90 which adjusts the ground point on endless cable 67 in order to change the TCL of the optical path between the document glass and the image plane. Details of the TCL cam are shown on FIG. 9, but the operation can best be explained with reference to FIG. 4.

The TCL cam adjusts the position of ground point 71. Suppose that the adjustment to the ground point is made in direction F. When that happens, carriage 61 remains stationary, but carriage 60, which is rigidly attached to endless cable 67 through clamp 69, is moved toward carriage 61. In that manner, the TCL is shortened prior to the start of scan. Similarly, if ground point 71 is moved by the TCL cam in direction G, the carriage 60 will be moved further away from carriage 61, thus increasing the TCL. In that manner, TCL is adjusted for every reduction ratio in a continuous manner so that whatever the reduction ratio selected, focal sharpness at the image plane is maintained.

Referring again to FIG. 5, note that the rotation of the TCL cam is performed by energization of motor 87 and thus the TCL is adjusted in synchronism with the magnification adjustment so that whatever the document area encompassed by the positioning indicators 91 and 93, the magnification and focal sharpness are adjusted accordingly.

e. Adjustment of the Speed and Length of Scan

As previously described, when scanning a large document, and reducing it to put it on a relatively small image area, the scan must move at a greater velocity over a greater length in order to accomplish the scan in the proper length of time. Referring again to FIG. 5, note that as optics positioning motor 87 is energized, truck 81 is moved along lead screw 86. Drive carriage 74 moves with the truck 81 and is biased against drive arm 72 by the tensioning spring 75 (shown in FIG. 4). Thus, as drive carriage 74 is positioned at the top of drive arm 72, and arm 72 is then moved in direction B according to the dictates of cam 84, the drive carriage 74 is moved at a relatively fast speed over a relatively long distance. However, if drive carriage 74 has been positioned near the bottom of drive arm 72, then the same motion of arm 72 results in a slower velocity movement of drive carriage 74 in direction B and it also moves through a much shorter distance. Since drive cable 64 is connected around a pulley 74B on drive carriage 74, it is moved at a velocity and through a distance directly proportional to the velocity and distance through which drive carriage 74 is moved. Since cable 64 is directly connected to scan carriage 61, that carriage is moved at a velocity and through a distance proportional to the movement of drive carriage 74. And since carriage 60 is connected through endless cable 67 to the driven scan carriage 61, scan carriage 60 is also controlled by the distance and the speed of movement of drive carriage 74.

Note that as drive carriage 74 is moved down the arm 72, drive cable 64 is paid out, thus adjusting the starting position of scan carriages 60 and 61. This will be further discussed below.

Note also that the adjustment of the position of drive carriage 74 is due to the rotation of optics positioning motor 87 and is performed in synchronism with the adjustments for magnification and TCL.

f. The Leading Edge Adjustment

Figure 11:
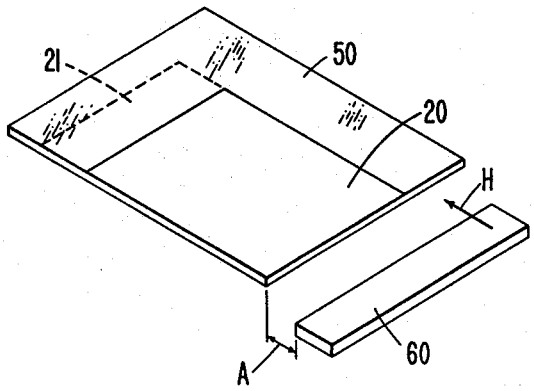
FIGS. 11 and 11*a* are diagrams for use in explaining leading edge adjustment.

As previously discussed, it is necessary to adjust some part of the optical system to ensure that the leading edge of the document is always laid down upon the leading edge of the image area, regardless of the magnification ratio selected. This problem is most easily understood through reference to FIG. 11 where document glass 50 is shown with document 20 and larger document 21 positioned thereon. Carriage 60 carrying the illumination lamp is shown positioned at a distance A from the leading edge of the document 20 (assuming that the scanning direction of carriage 60 is as shown by arrow H).

Figure 11A:
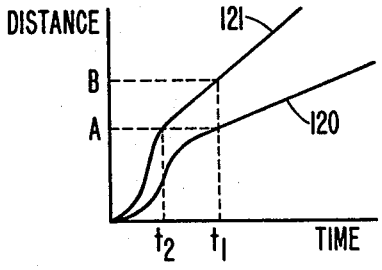

In FIG. 11*a*, which is a graph of the distance traveled by carriage 60 against the time it takes to travel that distance, note that for the curve 120 (which is a graph of the velocity of carriage 60 when it is called upon to scan document 20) the carriage 60 moves a distance A in time $t_1$. By the time $t_1$, the carriage is moving at a constant velocity as represented by the linear slope of line 120, and thus moves across document 20 at the proper constant speed. However, for slope 121 the carriage 60 moves the distance A in the time $t_2$. (Curve 121 is a graph of the velocity of carriage 61 when it is called upon to scan larger document 21.) Note that the constant velocity of scan carriage 60 is greater for curve 121 since it must scan the document 21 in the same length of time that document 20 was scanned, and, as a result, the acceleration is greater as shown on FIG. 11*a* and thus distance A is travelled in a shorter length of time. Assuming the scan for both curves 120 and 121 start at the same point in the drum cycle, the result is that the starting point of the scan, i.e., when the line of light first begins to scan across the document, occurs earlier in the rotative cycle of the drum for the larger document than it did for the smaller document. As a result, the leading edge of the image of document 21 is laid down on the drum sooner than it was when scanning document 20. As previously noted, this would bring the leading edge of the larger document 21 outside of the image area and some portion of that document would not be copied onto the copy paper.

The particular solution to this problem adopted in the preferred embodiment of this machine is to adjust the starting position of scan carriage 60 such that it travels a distance B (refer to FIG. 11*a*) before reaching the leading edge of document 21. In that manner, the time $t_1$ for beginning the scan of the documents is the same regardless of the document size being copied. Other solutions to this problem could involve adjusting the time at which the scan carriages are started and could involve the provision of a scanning carriage with such low inertia that the distance A and the distance B could both be reduced to approximate zero. A possible solution for some configurations could involve shifting the image by shifting the position of the lens.

The particular mechanism for adjusting the starting point of the scanning carriage in the preferred embodiment of the invention is best seen with reference to FIGS. 6 and 7. As noted above, when drive carriage 74 is moved along arm 72, drive cable 64 is taken up or paid out. In that manner, the starting position of scanning carriages 60 and 61 is changed with the magnification ratio selected. In order to fine adjust those starting points, the drive belt 64 is connected to an adjustable ground point 80 which is movable with reference to cam surface 130 as the truck 81 is moved along lead screw 86. Therefore, as the ground point 80 is shifted to the drive cable 64 is caused to be either taken up or paid out an additional small amount, with the result that the starting point of the carriages 60 and 61 is adjusted. Consequently, a system has been provided for adjusting the starting point of the scan carriages in a continuous manner through the action of an optics positioning motor 87.

The above-described mechanisms allow for adjusting the starting point of the scan carriages in synchronism with the magnification adjustment, the TCL adjustment, and the adjustment of the speed and length of scan, the adjustment of the lens in a second dimension for a corner referenced document, and also, of course, in conjunction with the movement of positioning indicators 91 and 93. In that manner, all adjustments which must be made prior to scan are made through the energization of one positioning motor and all adjustments are tied together to provide correct settings for all variables prior to scan. Furthermore, these adjustments are all organized to operate in a continuous fashion so that a continuously variable reduction machine is provided, operating between the boundaries set by the particular mechanisms chosen in a particular machine embodiment.

D. A Second Preferred Embodiment

Another embodiment of this invention is practiced by replacing the fixed focus lens 9 with a variable focus (zoom) lens. In such a system, the various figures shown for the first preferred embodiment remain unchanged except that the TCL cam, the magnification cam, and the associated adjusting mechanisms are either eliminated or altered and a mechanism for adjusting the variable focus lens elements is added.

With respect to the TCL adjustment and with reference to FIG. 9, the pulley 100 drives pulley 125 for moving the reduction indicators while moving ground point 71 is made into a stationary ground point by rigid connection to wall 52. The cam 90, the cam follower 101 and the linearly moving truck 102 are eliminated. With reference to FIG. 5, the cam 90 is eliminated but the remainder of the system as illustrated is unchanged.

With respect to magnification, the variable focus lens system may take two forms. In one form, the system is unchanged except that the shape of the magnification cam is altered to move the lens 9 along the rails 111 and 112 in accordance with the needs of the particular variable focus lens chosen. That is to say, for a particular reduction ratio, the interior movement of lens elements within the lens barrel provide for most of the needed change in magnification. However, some physical movement of the lens along the optical axis M may also be necessary to accomplish the needed change in magnification ratio. Thus, a differently shaped cam 89, matched to the variable focus lens 9, is used. Also, the shape of corner cam 131 may change and the inclination of rails 111 and 112 in the X dimension will change to maintain the corner reference. Aside from these "shape" changes, FIG. 10 remains the same.

In a second form of the variable focus lens system, all of the needed change in reduction ratio is accomplished by the interior movement of lens elements. In this case, the lens 9 is fastened to a single carriage which moves only in the X dimension, thus eliminating magnification cam 89, carriage 138, and all associated adjusting mechanisms. However, a cam such as cam 89, driven by drive cable 88, must replace cam 131 to move carriage 110 along rails 111 and 112 which are now oriented parallel to the X axis. The lens, of course, would continue to be oriented along the optical axis.

A mechanism for adjusting the interior lens elements to change the magnification ratio is necessary for both forms of the variable focus lens embodiment. Since standard variable focus lenses are adjusted by a simple rotation of the lens barrel, such a mechanism is added to FIG. 10 by cutting a slot in the mount for the lens, such as a slot in carriage 110, extending an arm rigidly fastened to the lens barrel through the slot, and moving the arm from a variable focus cam driven by drive cable 88.

E. A Third Preferred Embodiment

Figure 12A:
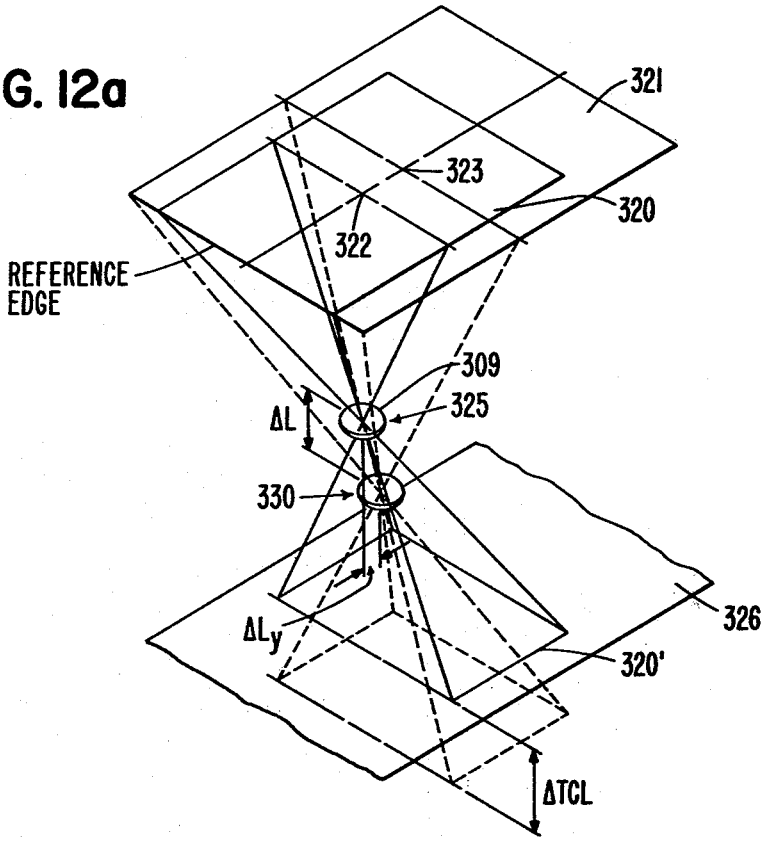
FIG. 12*a*, a diagram similar to FIG. 2*a*, shows an unfolded ray trace of a full-exposure imaging system.
Figure 12B:
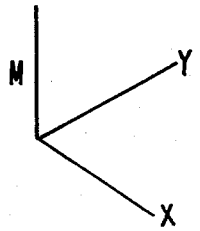
FIG. 12*b* shows orthogonal axis for reference in FIG. 12*a*.

Refer to FIG. 12*a*, a view similar to FIG. 2*a* in that optical principles are shown where documents of different size are to be copied onto the same size copy paper. FIG. 12*a* expresses these principles for a full-exposure system as opposed to a scanning system as shown in FIG. 2*a*. In FIG. 12*a* a first document 320 with a center point 322, is located on a document plane such that an edge of the document 320 is centered along a reference edge. A ray trace has been drawn for one-half of document 320 to show the corresponding half-image 320' on image plane 326, where the photoreceptor is located. The image is produced by rays of light traveling through the lens 309 located at position 325.

When a larger document 321 is placed upon the document plane, centered along a reference edge, the lens 309 must be moved to a different position 330 in order for the larger document to be copied in the same image area 320' into which the smaller document was copied. The amount of lens movement is determined by the lens formula supra. Also, in order to maintain the edges of the image in juxtaposition for the different size documents, the lens must also be moved in a second dimension, the Y dimension in this case, as shown in FIG. 12*a*, by $\Delta L_Y$. This movement is necessary to maintain the edges of the reduced images of document 321 in the same image area produced by the image of document 320. It may be noted that the center 322 of document 320 does not correspond to the center 323 of document 321. As a result, the center of the exposure area is shifted in the Y dimension. It is for that reason that the lens must also be shifted in the Y dimension in a full-exposure system to retain image edge relationships.

As previously explained with reference to FIG. 2*a*, the image of the reduced document falls into focus at a plane somewhat lower than the plane of the photoreceptor 326. That distance is represented by $\Delta$TCL. To bring the image of the larger document into focus at the image plane 326, one solution previously adopted in the embodiments discussed used a folded optical system in which rays of light are bent to provide the necessary optical path to bring the image into sharp focus despite the reduction. For a full-exposure system, a similar solution may also be adopted.

Figure 13:
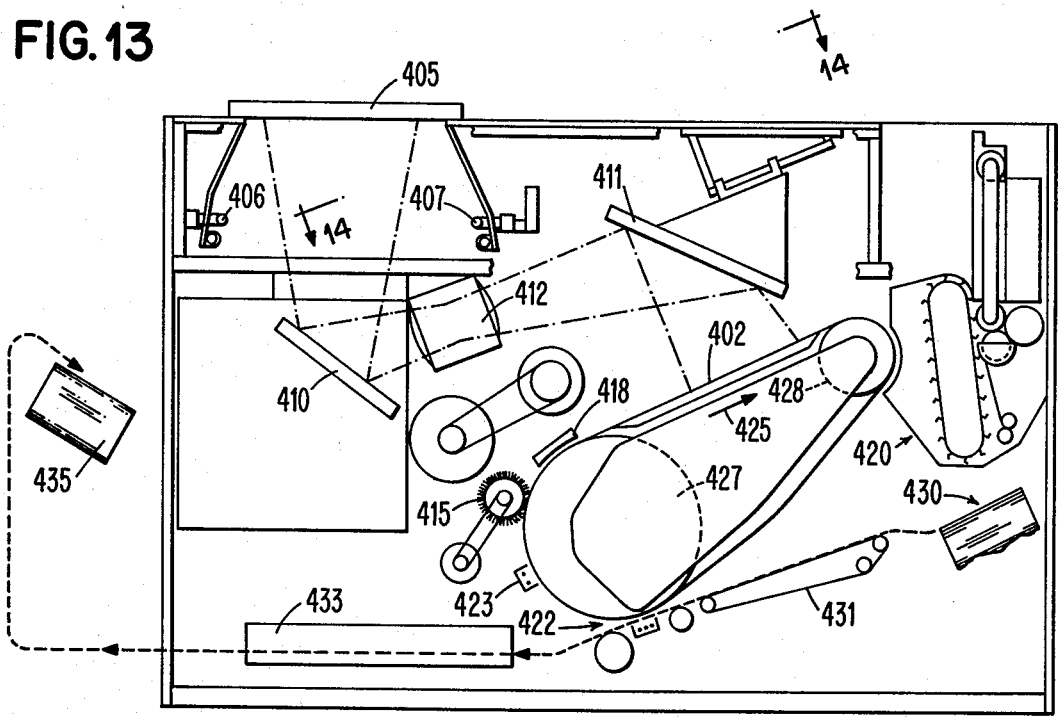
FIG. 13 shows a front view of a document copier utilizing a full-exposure optics.

FIG. 13 shows a full-exposure system incorporating the principles of this invention to provide a continuously variable reduction, full-exposure optical system.

A document is positioned on document glass 405, whereupon flash exposure lamps 406 and 407 produce the illumination necessary to cause rays of light to pass from the document plane to a stationary mirror 410 through a lens 412 to a movable mirror 41 and from there to a continuous belt photoreceptor 402. Photoreceptor 402 is mounted on two rotating drums 427 and 428 and moves in direction 425. Other components of the system include a developing unit 420 which develops the latent electrostatic images produced on the photoreceptor through flash exposure. Copy paper from bin 430 moves across conveyor 431 to the transfer station 422 where the developed electrostatic image is transferred to the copy paper. The copy paper continues through fuser 433 to an output pocket 435. A preclean corona 423 and a cleaning station 415 remove the electrostatic image and the developing material from the photoreceptor 402 prior to the passage of the photoreceptor under charging corona 418. All of these components operate according to the well-known xerographic process principles.

Figure 14:
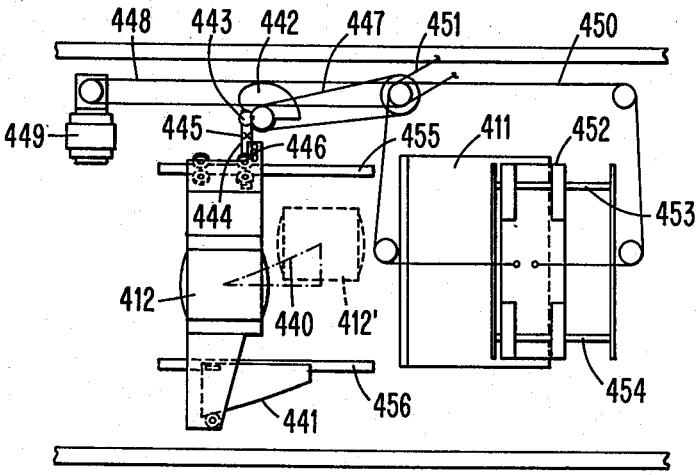
FIG. 14 illustrates the continuously adjustable lens and mirror mechanisms and positioning drive in a full-exposure system.

FIG. 14 shows the movement of single-focus lens 412 along a curvilinear path 440 to position 412'. The lens is moved under the influence of magnification cam 442, the cam follower 443, and an arm 444 which pviots around point 445. Arm 444 contacts a pin 446 which is fastened to the lens carriage for moving of the lens as can be more clearly seen in FIGS. 15 and 16. Cam 442 is driven from a cable 447 which in turn is driven through a cable 448 by motor 449. Mirror 411 is moved by cables 450 and 448 as a result of rotation of motor 449. Cable 451, also driven by motor 449, drive reduction indicators (not shown) for informing the operator when the indicators frame the desired document area on the document glass, similar to the arrangement already shown in FIG. 5. Mirror 411 is mounted on a mirror carriage 452 which rides along rails 453 and 454. Lens 412 is mounted in carriages which ride along rails 455 and 456.

Figure 15:
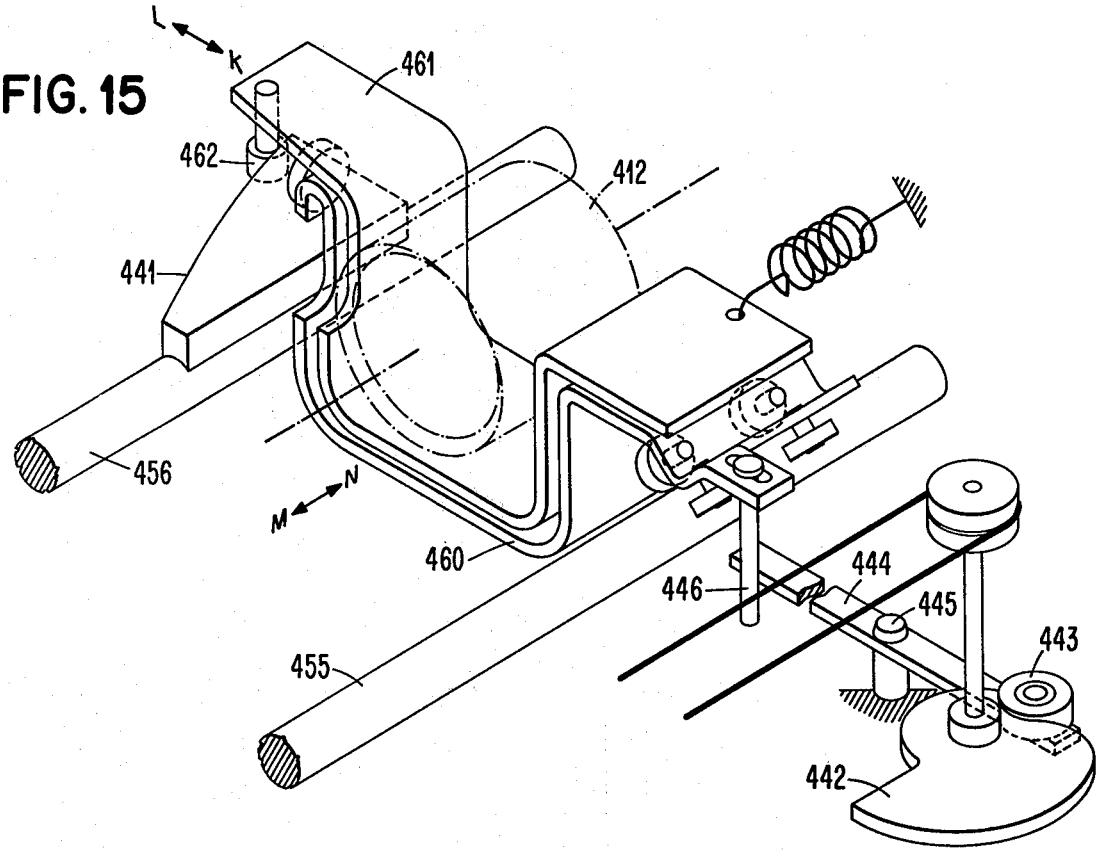
FIG. 15 shows a lens carriage for use in a single-edge referencing, full-exposure, continuously variable reduction system.

Referring now to FIG. 15, which is similar to FIG. 10, lens 412 is shown mounted in lens carriage 461 which in turn is mounted in lens carriage 460 in a manner heretofore described with reference to FIG. 10. Carriage 460 is moved along rails 455 and 456 under the influence of magnification cam 442, cam follower 443, and arm 444 which moves around pivot point 445. The arm 444 bears against pin 446 which in turn is fastened to the carriage 460.

Lens carriage 461 is allowed to move relative to carriage 460 in directions K and L. Thus, as carriage 460 is moved along the magnification axis in direction M, lens carriage 461 moves in direction K under the influence of corner cam 441 and cam follower 462. This movement provides the curvilinear movement 440 shown in FIG. 14 and corresponds to the $\Delta L_Y$ movement described with reference to FIG. 12*a*. Carriage 461 is spring biased (not shown) in direction k in order to hold follower 462 against cam 441. Rails 455 and 456 are parallel to the optical axis.

Figure 16:
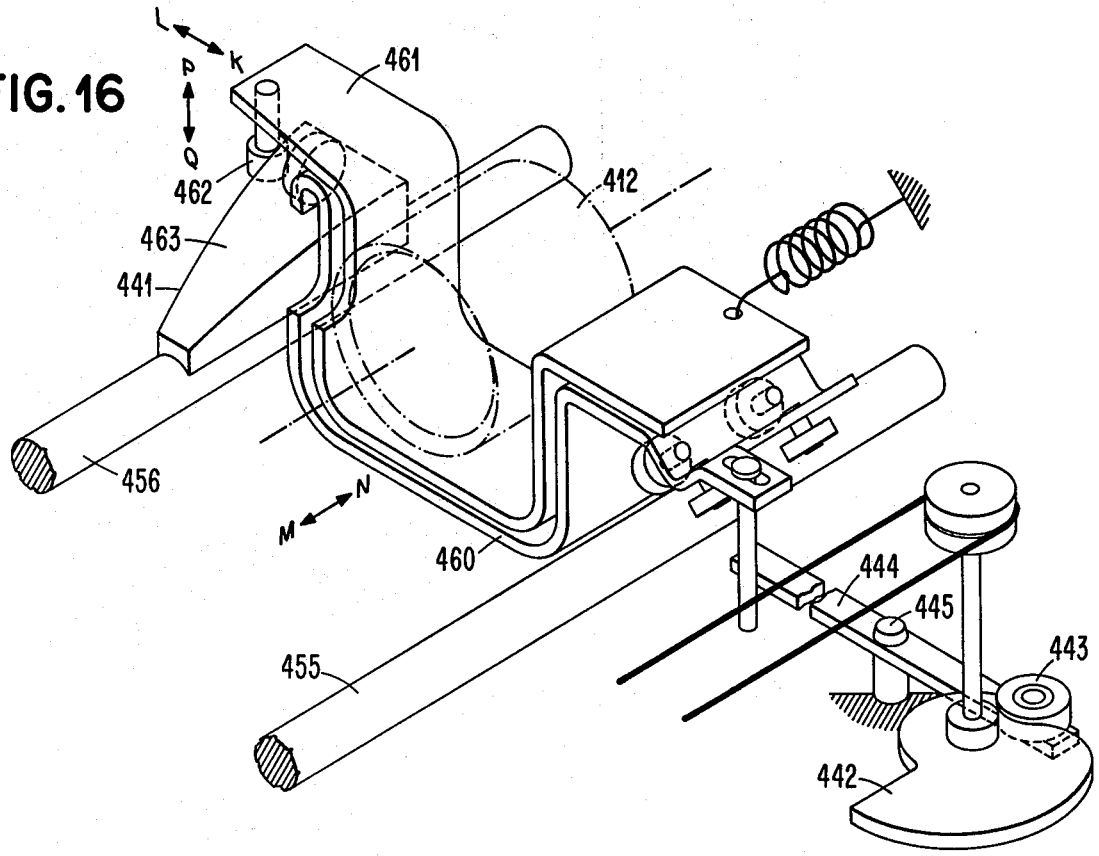
FIG. 16 shows a lens carriage for use in a corner referencing, full-exposure, continuously variable reduction system.

FIG. 16 is exactly the same as FIG. 15, except that carriage 461 moves in two directions relative to carriage 460, i.e., as carriage 460 moves in direction M, carriage 461 moves in direction K as before, but also moves in direction Q under the influence of cam surface 463. Thus, single-focus lens 412 is provided a three-dimensional movement which is necessary when the documents are corner referenced on the document plane, the system is a full-exposure, continuous reduction system, and image edges are to be maintained at the image plane. This is due to the fact that the center of the exposure area is moved in two dimensions, both X and Y, as shown in FIG. 2*a*. Note that in the scanning system shown in FIG. 2*a*, the center of the line exposure area moved in only the X dimension while in FIG. 12*a*, where the documents were center-edge referenced, the center of the full-exposure area moved only in dimension Y.

In operation, a document is placed on the document glass 405 (FIG. 13) and the operator presses a switch (not shown) to move indicators, such as shown in FIG. 5, to encompass the area of the document glass needed to frame the document. These indicators are moved by motor 449 and associated drive transmission apparatus. Concurrently with movement of the indicators, motor 449 also continuously alters the position of lens 412 by driving magnification cam 442. Additional continuous lens movement in the LK and PQ directions, according to FIGS. 15 and 16, are accomplished through cam surfaces 441 and 463 as described above. These continuous movements maintain the edges of the image regardless of the magnification ratio selected.

Energization of motor 449 also moves mirror 411 in a continuously variable manner to provide the necessary change in total conjugate length to provide sharp images on the photoreceptor regardless of the magnification ratio selected.

F. Other Applications

It should be recognized that the principles of this invention can be applied to other systems. For example, the specific scanning system embodiments described above call for a stationary object plane and a stationary image plane and adjust for changes in TCL by using mirrors in a folded optical system or by using a variable focus lens. However, it is possible to utilize the inventive principles herein in a machine where the object plane, for example, is moved for the TCL adjustment. To provide a continuously variable system, such movement could be successfully accomplished from a cam or from a variable pitch leadscrew.

Also, the two scanning system embodiments described above utilize a scanning mirror system for moving a line of light across the stationary document. However, it is well known in the prior art to provide a moving document platen, moving past a stationary illuminating line of light as discussed above with reference to FIG. 2*a*. The principles of this invention are applied to such a system by connecting the drive cables to a document carriage and making mirror 46 stationary. All other components of the system would be unaffected except for the TCL adjustment which would be made by moving mirrors 47 and 48 by the TCL cam. Even that change can be eliminated by using a variable focus lens embodiment as described above.

Another variation known in the prior art to which this invention may be applied is to use a scanning lens in place of the scanning mirrors. In this case, the document is usually stationary and a line of light is moved across the document. Mirrors 46, 47, and 48 are eliminated so that the light is directed to the lens 9 which moves with the line of light; lens 9 could be a fixed focus or a variable focus lens. Such a system would, however, require a rather complete reconstruction of the embodiment shown herein.

With reference to the full-exposure embodiment of this invention, a variable focus lens could be used in place of the single focus lens movements described. If complete magnification adjustment is built into the variable focus lens, magnification cam 442 could be eliminated. However, the lens would still need to be continuously shifted in direction LK (single edge reference) or in directions LK and PQ (corner reference) in order to maintain edge image relationships. To do this, rails 455 and 456 would be oriented in the LK direction and cam 441 would be replaced by a cam such as cam 442 driven by the motor 449 to move the lens along the rails. The lens, of course, would continue to be oriented along the optical axis. If movement in the PQ direction were required, identical cams situated along both rails could provide that movement as the lens is moved along the rails.

While the principles of the invention have been described in connection with specific apparatus, it is to be clearly understood that this description is made only by way of example and not as a limitation to the scope of the invention as set forth in the objects thereof and in the accompanying claims.

What is claimed is:

1. A continuously variable reduction imaging system for an electrophotographic copying machine wherein documents to be copied are typically of various rectangular sizes, comprising:

a glass platen mounted on said machine for supporting said documents of various sizes in a document plane, said documents located on said document plane along at least one common reference edge;

a photoconductive surface mounted in said machine;

main motive means operatively connected to said photoconductive surface for moving said surface in said machine;

a source of illumination for illuminating said document plane;

an optics system for directing light from the illuminated document plane to an image plane on said photoconductive surface, said optics system including a lens in a lens barrel and means for adjusting said lens to obtain continuously variable magnification;

a lens supporting member mounted in said machine for continuous movement along a path to a first position to produce a first image sized approximately the same as a first document area and to a second position to produce a second image from a second document area larger than said first document area;

lens guide means mounted in said machine for supporting said lens supporting member, to provide a guideway for lens movement; and an optics positioning system for positioning said lens supporting member along said guideway to continuously variable positions including lens positioning means for shifting said lens supporting member to continuously variable positions in a direction perpendicular to the magnification axis, whereby said documents of various rectangular sizes are copied onto a common size copy paper.

2. The imaging system of claim 1 wherein said lens supporting member provides a mount for maintaining the orientation of the center line of said lens barrel parallel to the magnification axis regardless of the position at which the continuous lens movement is halted.

3. The imaging system of claim 1 wherein said optics positioning system further includes means for shifting said lens supporting member to continuously variable positions in a direction parallel to the magnification axis which combined with motion perpendicular to the magnification axis causes said lens to follow a curvilinear path along which the lens is positioned at any point.

4. The imaging system of claim 3 wherein said lens supporting member provides a mount for maintaining the orientation of the center line of the lens barrel parallel to the magnification axis regardless of the position at which the continuous movement is halted.

5. The imaging system of claim 1 wherein said optics system includes a document scanning system comprised of a scanning carriage for directing illumination from said source to said document.

6. The imaging system of claim 2 wherein said optics system includes a document scanning system comprised of a scanning carriage for directing illumination from said source to said document.

7. The imaging system of claim 3 wherein said optics system includes a document scanning system comprised of a scanning carriage for directing illumination from said source to said document.

8. The imaging system of claim 4 wherein said optics system includes a document scanning system comprised of a scanning carriage for directing illumination from said source to said document.

9. The imaging system of claim 8 further including means for adjusting the focal sharpness of said optics system in a continuous manner so that whatever the magnification ratio selected, the image remains sharp.

10. The imaging system of claim 9 wherein said lens supporting member comprises first and second lens carriages, said first lens carriage movable to continuously variable positions along the magnification axis, said second lens carriage movable to continuously variable positions in a direction perpendicular to said magnification axis.

11. The imaging system of claim 9 wherein said means for adjusting focal sharpness include movable reflective surfaces arranged to fold the optical path of said illumination.

12. The imaging system of claim 11 wherein said lens is a single focus lens, wherein said glass platen is located in a stationary document plane, wherein said image is produced on said photoconductive surface in a stationary image plane, and wherein said movable reflective surfaces adjust the length of the optical path in a continuous manner so that the image remains sharp on said stationary image plane despite changes in the magnification ratio.

13. The imaging system of claim 12 including magnification cam means for adjusting the position of said lens, according to a command from said optics positioning system.

14. The imaging system of claim 13 wherein said document scanning system is further comprised of two scanning carriages, one of which carries two mirrors, in directing the illumination from said document to said photoconductive surface, one of said scanning carriages driven during scan at half the speed of the other carriage.

15. The imaging system of claim 14 further including means for driving said scanning carriages directly connected to the slower moving of the two scanning carriages, and wherein the faster carriage is driven by connection to the slower carriage.

16. The imaging system of claim 15 wherein the focal sharpness adjustment comprises means for adjusting the optical path distance between the two scanning carriages prior to scan start, said means including a focal sharpness cam through which a cam follower is positioned according to a command from said optics positioning system according to the magnification ratio selected.

17. The imaging system of claim 16 further including locating means for maintaining the reference edge of the document at a constant position on the image plane regardless of the selected magnification ratio.

18. The imaging system of claim 17 wherein said locating means comprises a locating cam for adjusting the start position of said two carriages, said locating cam being positioned by said optics positioning system in accordance with the magnification ratio selected.

19. The imaging system of claim 18 wherein said driven scanning carriage is driven at a constant speed, said constant speed being variably adjustable in a continuous manner in accordance with the magnification ratio selected.

20. The imaging system of claim 19 wherein said scanning carriage for directing illumination to said document is moved a distance to start and complete the scan of said document in a fixed time interval, and wherein said distance is continuously adjustable in accordance with the magnification ratio selected.

21. The imaging system of claim 20 further including a reciprocating drive arm, a drive carriage located for movement with said arm, a drive cable connected to said drive carriage and said driven scanning carriage, a truck in which said drive carriage is mounted, and means for positioning said truck such that said drive carriage is positioned in a continuously variable manner along said drive arm by said optics positioning system, whereby the speed and length of scan is set in accordance with the magnification ratio selected.

22. The imaging system of claim 21 wherein said lens supporting member provides a mount for maintaining the orientation of the center line of the lens barrel parallel to the magnification axis regardless of the position at which the continuous movement is halted.

23. The imaging system of claim 22 wherein said lens supporting member includes first and second lens carriages, said first lens carriage moved under the influence of said magnification cam, said imaging system including a corner cam for maintaining an image corner reference regardless of magnification ratio, said second lens carriage carried by said first carriage but movable in one dimension relative to said first lens carriage, said second lens carriage moved in said one dimension under the influence of said corner cam.

24. The imaging system of claim 9 wherein said scanning carriage is driven at a constant speed, said constant speed being variably adjustable in a continuous manner in accordance with the magnification ratio selected.

25. The imaging system of claim 24 wherein said scanning carriage for directing illumination to said document is moved a distance to start and complete the scan of said document in a fixed time interval, and wherein said distance is continuously adjustable in accordance with the magnification ratio selected.

26. The imaging system of claim 24 further including locating means for maintaining the reference edge of the document at a constant position on the image plane regardless of the selected magnification ratio.

27. The imaging system of claim 26 wherein said glass platen is located in a stationary document plane, wherein said image is produced on said photoconductive surface in a stationary image plane, and wherein said movable reflective surfaces adjust the length of the optical path in a continuous manner so that the image remains sharp on said stationary image plane despite changes in the magnification ratio.

28. The imaging system of claim 27 wherein said document scanning system is further comprised of two scanning carriages, one of said carries two mirrors, in directing the illumination from said document to said photoconductive surface, one of said scanning carriages drive during scan at half the speed of the other carriage.

29. The imaging system of claim 28 further including a reciprocating drive arm, a drive carriage located for movement with said arm, a drive cable connected to said drive carriage and said driven scanning carriage, a truck in which said drive carriage is mounted, and means for positioning said truck such that said drive carriage is positioned in a continuously variable manner along said drive arm by said optics positioning system, whereby the speed and length of scan is set in accordance with the magnification ratio selected.

30. The imaging system of claim 2 wherein said optics system includes flash exposure means for producing illumination at said document plane, and mirrors for directing said illumination to said photoconductive surface.

31. The imaging system of claim 30 wherein said optics positioning system further includes means for shifting said lens supporting member to continuously variable positions in a direction parallel to the magnification axis which combined with motion perpendicular to the magnification axis causes said lens to follow a curvilinear path along which the lens is positioned at any point.

32. The imaging system of claim 30 wherein said optics positioning system includes means for shifting said lens supporting member to continuously variable positions in a second direction perpendicular to the magnification on axis.

33. The imaging system of claim 32 wherein said optics positioning system further includes means for shifting said lens supporting member to continuously variable positions in a direction parallel to the magnification axis which combined with motion perpendicular to the magnification axis causes said lens to follow a curvilinear path along which the lens is positioned at any point.

34. The imaging system of claim 30 further including means for adjusting the focal sharpness of said optics system in a continuous manner so that whatever the magnification ratio selected, the image remains sharp.

35. The imaging system of claim 31 wherein said lens supporting member comprises first and second lens carriages, said first lens carriage movable to continuously variable positions along the magnification axis, and said second lens carriage movable to continuously variable positions in a direction perpendicular to said magnification axis.

36. The imaging system of claim 35 wherein said second carriage is movable to continuously variable positions in a second direction perpendicular to said magnification axis.

37. A continuously variable magnification optics system comprising:

a lens;

first means for adjusting the position of said lens along the magnification axis in a continuously settable manner between magnification ratio boundaries;

second means for positioning said lens along a direction perpendicular to the magnification axis in a continuously settable manner between said boundaries; and drive means for moving said first means and said second means.

38. The system of claim 37 in which the orientation of the centerline of said lens remains parallel to the magnification axis regardless of the position at which the continuous lens movement is halted.

39. The system of claim 38 further including a lens supporting member comprised of first and second lens carriages, said first lens carriage movable to continuously variable positions along the magnification axis, said second lens carriage movable to continuously variable positions in a direction perpendicular to said magnification axis.

40. The system of claim 39 further including means for adjusting the focal sharpness of said optics system in a continuous manner so that whatever the magnification ratio selected, the image remains sharp.

41. The system of claim 40 wherein said means for adjusting focal sharpness includes movable reflective surfaces arranged to fold the optical path between the object and image planes.

42. The system of claim 41 wherein said lens is a single-focus lens and wherein the object and image planes are stationary.

43. The system of claim 42 including magnification cam means for adjusting the position of said lens according to the desired magnification ratio.

44. The system of claim 43 further including scanning means carrying a source of illumination for directing illumination from said source across the object plane.

45. The system of claim 44 wherein said scanning means is further comprised of two scanning carriages and wherein the focal sharpness adjustment comprises means for adjusting the optical path length between the two scanning carriages prior to scan start, said means including a focal sharpness cam through which a cam follower is positioned according to the magnification ratio selected.

46. The system of claim 45 further including locating means for maintaining a reference edge of the object plane on the image plane at a constant position regardless of the selected magnification ratio.

47. The system of claim 46 wherein said locating means comprises a locating cam for adjusting the start position of said two carriages, said locating cam being positioned in accordance with the magnification ratio selected.

48. The system of claim 47 wherein said scanning carriages are driven at constant speeds, said constant speeds being variably adjustable in a continuous manner in accordance with a selection made prior to scan start of a magnification ratio.

49. The system of claim 48 wherein said scanning means for directing illumination from said source to said object plant is moved a distance to start and complete the scan of said object plane in a fixed time interval, and wherein said distance is continuously adjustable in accordance with the magnification ratio selected.

50. The system of claim 49 further including a reciprocating drive arm, a drive carriage located for movement with said arm, a drive cable connected to one of said drive carriages and one of said scanning carriages, a truck in which said drive carriage is mounted, and means for positioning said truck such that said drive carriage is positioned in a continuously variable manner along said drive arm, whereby the speed and length of scan is set in accordance with the magnification ratio selected.

51. The system of claim 50 wherein said lens supporting member includes first and second lens carriages, said first lens carriage moved under the influence of said magnification cam, said imaging system including a corner cam for maintaining an image corner reference regardless of magnification ratio, said second lens carriage carried by said first carriage but movable in one dimension relative to said first lens carriage, said second lens carriage moved in said one dimension under the influence of said corner cam.

52. The system of claim 45 wherein said scanning carriages are driven at constant speeds, said constant speeds being variable adjustable in a continuous manner in accordance with a selection made prior to scan start of a magnification ratio.

53. The system of claim 54 further including a reciprocating drive arm, a drive carriage located for movement with said arm, a drive cable connected to one of said drive carriages and one of said scanning carriages, a truck in which said drive carriage is mounted, and means for positioning said truck such that said drive carriage is positioned in a continuously variable manner along said drive arm, whereby the speed and length of scan is set in accordance with the magnification ratio selected.

54. A continuously variable magnification system comprising:

a glass platen mounted for supporting documents of various sizes in an object plane, said documents located along at least one common reference edge;

a source of illumination for illuminating said object plane;

an optics system for directing light from the illuminated object plane to an image plane, said optics system including a lens and means for adjusting said lens to obtain continuously variable magnification;

a lens supporting member mounted for continuous movement along a path to a first position to produce a first image sized approximately the same as a first document area and to a second position to produce a second image from a second document area larger than said first document area;

lens guide means for supporting said lens supporting member to provide a guideway for lens movement; and an optics positioning system for positioning said lens supporting member along said guideway to continuously variable settings including means for shifting said lens supporting member to continuously variable positions in a direction perpendicular to the magnification axis.

55. The system of claim 54 wherein said lens supporting member provides a mount for maintaining the orientation of the centerline of said lens barrel parallel to the magnification axis regardless of the position at which the continuous lens movement is halted.

56. The system of claim 55 further including means for adjusting the focal sharpness of said optics system in a continuous manner so that whatever the magnification ratio selected, the image remains sharp.

57. The system of claim 56 further including locating means for maintaining a reference edge of the object plane on the image plane at a constant position regardless of the selected magnification ratio.

58. The system of claim 57 wherein said lens is a single-focus lens and wherein the object and image planes are stationary.

59. The system of claim 58 further including scanning means carrying a source of illumination for directing illumination from said source across the object plane.

60. The system of claim 59 wherein said scanning means is further comprised of two scanning carriages and wherein the focal sharpness adjustment comprises means for adjusting the optical path length between the two scanning carriages prior to scan start, said means including a focal sharpness cam through which a cam follower is positioned according to the magnification ratio selected.

61. The system of claim 60 wherein said scanning carriages are driven at constant speeds, said constant speeds being variably adjustable in a continuous manner in accordance with a selected magnification ratio, said ratio selected prior to scan start.

62. The system of claim 61 wherein said means for adjusting focal sharpness includes movable reflective surfaces arranged to fold the optical path of said illumination.

63. The system of claim 62 wherein said lens supporting member comprises first and second lens carriages, said first lens carriage movable to continuously variable positions along the magnification axis, said second lens carriage movable to continuously variable positions in a direction perpendicular to said magnification axis.

64. The system of claim 63 including magnification cam means for adjusting the position of said lens, according to a command from said optics positioning system.

65. The system of claim 64 wherein said locating means comprises a locating cam for adjusting the start position of said two scanning carriages, said locating cam being positioned by said optics positioning system in accordance with the magnification ratio selected.

66. The system of claim 65 wherein said scanning means for directing illumination from said source to said object plane is moved a scan distance to start and complete the scan of said object plane in a fixed time interval, and wherein said scan distance is continuously adjustable in accordance with the magnification ratio selected.

67. The system of claim 66 further including a reciprocating drive arm, a drive carriage located for movement with said arm, a drive cable connected to one of said drive carriages and one of said scanning carriages, a truck in which said drive carriage is mounted, and means for positioning said truck such that said drive carriage is positioned in a continuously variable manner along said drive arm, whereby the speed and length of scan is set in accordance with the magnification ratio selected.

68. The system of claim 67 wherein said lens supporting member includes first and second lens carriages, said first lens carriage moved under the influence of said magnification cam, said imaging system including a corner cam for maintaining an image corner reference regardless of magnification ratio, said second lens carriage carried by said first carriage but movable in one dimension relative to said first lens carriage, said second lens carriage moved in said one dimension under the influence of said corner cam.

69. A continuously variable reduction imaging system for an electrophotographic copying machine wherein documents to be copied are typically of various rectangular sizes, comprising:

a glass platen mounted on said machine for supporting said documents of various sizes in a document plane, said documents located on said document plane along at least one common reference edge;

a photoconductive surface mounted in said machine;

main motive means operatively connected to said photoconductive surface for moving said surface in said machine;

a source of illumination for illuminating said document plane;

an optics system for directing light from the illuminated document plane to an image plane on said photoconductive surface, said optics system including a lens in a lens barrel and means for adjusting said lens to obtain continuously variable magnification;

a lens supporting member mounted in said machine for continuous movement along a path to a first position to produce a first image sized approximately the same as a first document area and to a second document area larger than said first document area;

lens guide means mounted in said machine for supporting said lens supporting member, to provide a guideway for lens movement;

an optics positioning system for positioning said lens supporting member along said guideway to continuously variable positions including lens positioning means for shifting said lens supporting member to continuously variable positions in a direction perpendicular to the magnification axis; and focal sharpness means whose position is continuously adjustable in a single axis for adjusting the focal sharpness of said optical system so that whatever the magnification ratio selected, the image remains sharp, whereby said documents of various rectangular sizes are copied onto a common size copy paper.

70. The imaging system of claim 69 wherein said lens supporting member provides a mount for maintaining the orientation of the center line of said lens barrel parallel to the magnification axis regardless of the position at which the continuous lens movement is halted.

71. The imaging system of claim 69 wherein said optics positioning system further includes means for shifting said lens supporting member to continuously variable positions in a direction parallel to the magnification axis which combined with motion perpendicular to the magnification axis causes said lens to follow a curvilinear path along which the lens is positioned at any point.

72. The imaging system of claim 71 wherein said lens supporting member provides a mount for maintaining the orientation of the center line of the lens barrel parallel to the magnification axis regardless of the position at which the continuous movement is halted.

73. The imaging system of claim 69 wherein said optics system includes a document scanning system comprised of a scanning carriage for directing illumination from said source to said document.

74. The imaging system of claim 70 wherein said optics system includes a document scanning system comprises of a scanning carriage for directing illumination from said source to said document.

75. The imaging system of claim 71 wherein said optics system includes a document scanning carriage for directing illumination from said source to said document.

76. The imaging system of claim 72 wherein said optics system includes a document scanning system comprised of a scanning carriage for directing illumination from said source to said document.

77. The imaging system of claim 76 wherein said lens supporting member comprises first and second lens carriages, said first lens carriage movable to continuously variable positions along the magnification axis, said second lens carriage movable to continuously variable positions in a direction perpendicular to said magnification axis.

78. The imaging system of claim 77 wherein said focal sharpness means includes movable reflective surfaces to fold the optical path of said illumination.

79. The imaging system of claim 78 wherein said lens is a single focus lens, wherein said glass platen is located in a stationary document plane, wherein said image is produced on said photoreceptive material in a stationary image plane, and wherein said movable reflective surfaces adjust the length of the optical path in a continuous manner so that the image remains sharp on said stationary image plane despite changes in the magnification ratio.

80. The imaging system of claim 79 wherein said single axis of movement of the position of said focal sharpness means is parallel to the axis of movement of said scanning carriage.

81. The imaging system of claim 80 including magnification cam means for adjusting the position of said lens, according to a command from said optics positioning system.

82. The imaging system of claim 81 wherein said document scanning system is further comprised of two scanning carriages, one of which carries two mirrors, in directing the illumination from said document to said photoreceptive material, one of said scanning carriages driven during scan at half the speed of the other carriage.

83. The imaging system of claim 82 wherein the focal sharpness adjustment comprises means for adjusting the optical path distance between the two scanning carriages prior to scan start, said means including a focal sharpness cam through which a cam follower is positioned according to a command from said optics positioning system according to the magnification ratio selected.

84. The imaging system of claim 83 further including locating means for maintaining the reference edge of the document at a constant position on the image plane regardless of the selected magnification ratio.

85. The imaging system of claim 84 wherein said locating means comprises a locating cam for adjusting the start position of said two carriages, said locating cam being positioned by said optics positioning system in accordance with the magnification ratio selected.

86. The imaging system of claim 85 wherein said driven scanning carriage is driven at a constant speed, said constant speed being variable adjustable in a continuous manner in accordance with the magnification ratio selected.

87. The imaging system of claim 86 wherein said sanning carriage for directing illumination to said document is moved a distance to start and complete the scan of said document in a fixed time interval, and wherein said distance is continuously adjustable in accordance with the magnification ratio selected.

88. The imaging system of claim 87 wherein said lens supporting member provides a mount for maintaining the orientation of the center line of the lens barrel parallel to the magnification axis regardless of the position at which the continuous movement is halted.

89. The imaging system of claim 88 wherein said lens supporting member includes first and second lens carriages, said first lens carriage moved under the influence of said magnification cam, said imaging system including a corner cam for maintaining an image corner reference regardless of magnification ratio, said second lens carriage carried by said first carriage but movable in one dimension relative to said first lens carriage said second lens carriage moved in said one dimension under the influence of said corner cam.

90. The imaging system of claim 70 wherein said optics system includes flash exposure means for producing illumination at said document plane, and mirrors for directing said illumination to said photoconductive surface.

91. The imaging system of claim 90 wherein said optics positioning system further includes means for shifting said lens supporting member to continuously variable positions in a direction parallel to the magnification axis which combined with motion perpendicular to the magnification axis causes said lens to follow a curvilinear path along which the lens is positioned at any point.

92. The imaging system of claim 90 wherein said optics positioning system includes means for shifting said lens supporting member to continuously variable positions in a second direction perpendicular to the magnification axis.

93. The imaging system of claim 92 wherein said optics positioning system further includes means for shifting said lens supporting member to continuously variable positions in a direction parallel to the magnification axis which combined with motion perpendicular to the magnification axis causes said lens to follow a curvilinear path along which the lens is positioned at any point.

94. The imaging system of claim 91 wherein said lens supporting member comprises first and second lens carriages, said first lens carriage movable to continuously variable positions along the magnification axis, and said second lens carriage movable to continuously variable positions in a direction perpendicular to said magnification axis.

95. The imaging system of claim 94 wherein said second carriage is movable to continuously variable positions in a second direction perpendicular to said magnification axis.

96. A continuously variable reduction imaging system for an electrophotographic copying machine wherein documents to be copied are typically of various rectangular sizes, comprising:

a glass platen mounted on said machine for supporting said documents on various sizes in a document plane, said documents located on said document plane along at least one common reference edge;

a photoconductive surface mounted in said machine;

main motive means operatively connected to said photoconductive surface for moving said surface in said machine;

a source of illumination for illuminating said document plane;

an optics system for directing light from the illuminated document plane to an image plane on said photoconductive surface, said optics system including a lens in a lens barrel and means for adjusting said lens to obtain continuously variable magnification;

a lens supporting member mounted in said machine for continuous movement along a path to a first position to produce a first image sized approximately the same as a first document area and to a second position to produce a secod image from a second document area larger than said first document area;

lens guide means mounted in said machine for supporting said lens supporting member, to provide a guideway for lens movement;

an optics positioning system for positioning said lens supporting member along said guideway to continuously variable positions including lens positioning means for shifting said lens supporting member to continuously variable positions in a direction perpendicular to the magnification axis; and said optics system including two document scanning carriages for directing illumination from said document to said photoreceptive surface, said two carriages movable in a single scanning axis, whereby said documents of various rectangular sizes are copied onto a common size copy paper.

97. The imaging system of claim 96 wherein said lens supporting member provides a mount for maintaining the orientation of the center line of said lens barrel parallel to the magnification axis regardless of the position at which the continuous lens movement is halted.

98. The imaging system of claim 96 wherein said optics positioning system further includes means for shifting said lens supporting member to continuously variable positions in a direction parallel to the magnification axis which combined with motion perpendicular to the magnification axis causes said lens to follow a curvilinear path along which the lens is positioned at any point.

99. The imaging system of claim 98 wherein said lens supporting member provides a mount for maintaining the orientation of the center line of the lens barrel parallel to the magnification axis regardless of the position at which the continuous movement is halted.

100. The imaging system of claim 99 further including means for adjusting the focal sharpness of said optics system in a continuous manner so that whatever the magnification ratio selected, the image remains sharp.

101. The imaging system of claim 100 wherein said lens supporting member comprises first and second lens carriages, said first lens carriage movable to continuously variable positioned along the magnification axis, said second lens carriage movable to continuously variable positions in a direction perpendicular to said magnification axis.

102. The imaging system of claim 101 wherein said means for adjusting focal sharpness include movable reflective surfaces arranged to fold the optical path of said illumination.

103. The imaging system of claim 102 wherein said lens is a single focus lens, wherein the glass platen is located in a stationary document plane, wherein said image is produced on said photoreceptive material in a stationary image plane, and wherein said movable reflective surfaces adjust the length of the optical path in a continuous manner so that the image remains sharp on said stationary image plane despite changes in the magnification ratio.

104. The imaging system of claim 103 wherein the focal sharpness adjustment comprises means for adjusting the optical path distance between the two scanning carriages prior to scan start, said means including a focal sharpness cam through which a cam follower is positioned according to a command from said optics positioning system according to the magnification ratio selected.

105. The imaging system of claim 104 including magnification cam means for adjusting the position of said lens, according to a command from said optics positioning system.

106. The imaging system of claim 105 further including locating means for maintaining the reference edge of the document at a constant position on the image plane regardless of the selected magnification ratio.

107. The imaging system of claim 106 wherein said locating means comprises a locating cam for adjusting the start position of said two carriages, said locating cam being positioned by said optics positioning system in accordance with the magnification ratio selected.

108. The imaging system of claim 107 wherein said document scanning carriages are driven at a constant speed, said constant speed being variable adjustable in a continuous manner in accordance with the magnification ratio selected.

109. The imaging system of claim 108 wherein said scanning carriage for directing illumination to said document is moved a distance to start and complete the scan of said document in a fixed time interval, and wherein said distance is continuously adjustable in accordance with the magnification ratio selected.

110. The imaging system of claim 109 wherein said lens supporting member provides a mount for maintaining the orientation of the center line of the lens barrel parallel to the magnification axis regardless of the position at which the continuous movement is halted.

111. The imaging system of claim 110 wherein said lens supporting member includes first and second lens carriages, said first lens carriage moved under the influence of said magnification cam, said imaging system including a corner cam for maintaining an image corner reference regardless of magnification ratio, said second lens carriage carried by said first carriage but movable in one dimension relative to said first lens carriage, said second lens carriage moved in said one dimension under the influence of said corner cam.

* * * * *

UNITED STATES PATENT AND TRADEMARK OFFICE

CERTIFICATE OF CORRECTION

PATENT NO. : 4,209,248

DATED : June 24, 1980

INVENTOR(S) : David K. Gibson et al

It is certified that error appears in the above-identified patent and that said Letters Patent are hereby corrected as shown below:

Column 6, line 52, "it it" should read --it is--.

Column 17, line 5, delete "41" and insert -- 411 --.

Column 22, line 7, delete "said" and insert --which--;
line 10, delete "drive" and insert --driven--.

Column 23, line 59, delete "plant" and insert --plane--.

Column 24, line 17, delete "variable" and insert --variably--.

Column 26, line 20, delete "54" and insert --52--.

Column 26, line 25, after "second" insert --position to produce a second image from a second--.

Column 26, line 67, delete "comprises" and insert --comprised--.

UNITED STATES PATENT AND TRADEMARK OFFICE

CERTIFICATE OF CORRECTION

PATENT NO. : 4,209,248 Page 2 of 2

DATED : June 24, 1980

INVENTOR(S) : David K. Gibson et al

It is certified that error appears in the above-identified patent and that said Letters Patent are hereby corrected as shown below:

Column 28, line 60, "documents on" should read --documents of--.

Column 29, line 54, delete "positioned" and insert --positions--.

Column 30, line 4, "wherein the glass" should read --wherein said glass--.

Column 30, line 35, delete "variable" and insert --variably--.

Signed and Sealed this

*Eighteenth* Day of *November 1980*

[SEAL]

*Attest:*

SIDNEY A. DIAMOND

*Attesting Officer* *Commissioner of Patents and Trademarks*